US009260771B2

(12) United States Patent
Furuya et al.

(10) Patent No.: US 9,260,771 B2
(45) **Date of Patent: *Feb. 16, 2016**

(54) NI-ADDED STEEL PLATE AND METHOD OF MANUFACTURING THE SAME

(75) Inventors: Hitoshi Furuya, Tokyo (JP); Naoki Saitoh, Tokyo (JP); Motohiro Okushima, Tokyo (JP); Yasunori Takahashi, Tokyo (JP)

(73) Assignee: NIPPON STEEL & SUMITOMO METAL CORPORATION, Tokyo ( * ) Notice: Subject to any disclaimer, the term of this patent is extended or adjusted under 35 U.S.C. 154(b) by 0 days.

This patent is subject to a terminal disclaimer.

(21) Appl. No.: 14/234,692

(22) PCT Filed: Sep. 28, 2011

(86) PCT No.: PCT/JP2011/072188

§ 371 (c)(1),
(2), (4) Date: Jan. 24, 2014

(87) PCT Pub. No.: WO2013/046357

PCT Pub. Date: Apr. 4, 2013

(65) Prior Publication Data

US 2014/0158258 A1 Jun. 12, 2014

(51) Int. Cl.
*C22C 38/40* (2006.01)
*C21D 8/02* (2006.01)
(Continued)

(52) U.S. Cl.
CPC ..... *C22C 38/40* (2013.01); *C21D 6/001* (2013.01); *C21D 6/04* (2013.01); *C21D 7/13* (2013.01);
(Continued)

(58) Field of Classification Search
CPC ..... C22C 38/40; C22C 38/44; C22C 38/04; C22C 38/16; C22C 38/06; C22C 38/0263; C22C 38/14; C22C 38/12; C22C 38/08; C22C 38/02; C22C 38/005; C22C 38/002; C22C 38/001; C21D 8/0226; C21D 6/04
USPC ..... 148/621, 645, 335
See application file for complete search history.

(56) References Cited

U.S. PATENT DOCUMENTS 4,946,516 A 8/1990 Yano et al.
8,882,942 B2 * 11/2014 Furuya et al. ..... 148/621

FOREIGN PATENT DOCUMENTS

CN 101314178 12/2008
CN 101328564 12/2008
(Continued)

OTHER PUBLICATIONS

International Search Report dated Jan. 10, 2012 issued in corresponding PCT Application No. PCT/JP2011/072188 [With English Translation].
(Continued)

*Primary Examiner* — Jessee Roe
(74) *Attorney, Agent, or Firm* — Kenyon & Kenyon LLP

(57) ABSTRACT

A Ni-added steel plate includes, by mass %, C: 0.04% to 0.10%, Si: 0.02% to 0.12%, Mn: 0.3% to 1.0%, Ni: more than 7.5% to 10.0%, Al: 0.01% to 0.08%, T.O: 0.0001% to 0.0030%, P: limited to 0.0100% or less, S: limited to 0.0035% or less, N: limited to 0.0070% or less, and the balance consisting of Fe and unavoidable impurities, in which a Ni segregation ratio at an area of ¼ of a plate thickness away from a plate surface in a thickness direction is 1.3 or less, a fraction of austenite after a deep cooling is 0.5% or more, an austenite unevenness index after the deep cooling is 3.0 or less, and an average equivalent circle diameter of the austenite after the deep cooling is 1 μm or less.

8 Claims, 4 Drawing Sheets

(51) Int. Cl.

| | |
|---|---|
| ***C22C 38/14*** | (2006.01) |
| ***C22C 38/00*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/12*** | (2006.01) |
| ***C22C 38/54*** | (2006.01) |
| ***C21D 6/00*** | (2006.01) |
| ***C21D 6/04*** | (2006.01) |
| ***C21D 7/13*** | (2006.01) |
| ***C21D 9/50*** | (2006.01) |
| ***C22C 38/16*** | (2006.01) |

(52) U.S. Cl.

CPC ..... *C21D 8/02* (2013.01); *C21D 8/0205* (2013.01); *C21D 8/0263* (2013.01); *C21D 9/50* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/54* (2013.01)

(56) References Cited

FOREIGN PATENT DOCUMENTS

| | | |
|---|---|---|
| CN | 101845599 | 9/2010 |
| EP | 1942203 | 7/2008 |
| JP | 56-156715 | 12/1981 |
| JP | 61-133312 | 6/1986 |
| JP | 63-130245 | 6/1988 |
| JP | 02-020922 | 5/1990 |
| JP | 02-141561 | 5/1990 |
| JP | 04-041054 | 2/1992 |
| JP | 04-014179 | 3/1992 |
| JP | 04-107219 | 4/1992 |
| JP | 04-371520 | 12/1992 |
| JP | 06-179909 | 6/1994 |
| JP | 07-278734 | 10/1995 |
| JP | 07-316654 | 12/1995 |
| JP | 09-020922 | 1/1997 |
| JP | 09-041036 | 2/1997 |
| JP | 09-041088 | 2/1997 |
| JP | 09-143557 | 6/1997 |
| JP | 2000-129351 | 5/2000 |
| JP | 2002-012951 | 1/2002 |
| JP | 2002-129280 | 5/2002 |
| JP | 2004-250766 | 9/2004 |
| JP | 2006-057136 | 3/2006 |
| JP | 2006-212671 | 8/2006 |
| JP | 2009-074123 | 4/2009 |
| JP | 2011-021243 | 2/2011 |
| KR | 10-2004-0054198 | 6/2004 |
| WO | WO 99/32672 | 7/1999 |
| WO | 2007/080645 | 7/2007 |
| WO | WO 2007/080646 | 7/2007 |
| WO | WO 2007/116913 | 10/2007 |
| WO | WO 2007/116919 | 10/2007 |

OTHER PUBLICATIONS

Office Action of Aug. 14, 2014 issued in related Chinese Application No. 201180073127.0 [with English Translation].

Extended European Search Report dated Mar. 20, 2015 issued in corresponding EP Application No. 11873206.4.

Seinosuke Yano et al., Effect of Heat Treatment in the Ferrite-Austenite Region on Notch Toughness of 6% Nickel Steel, Iron and Steel, The Iron and Steel Institute of Japan, 59th year, 1973, vol. 6, pp. 752-763.

International Search Report dated Sep. 27, 2011 issued in corresponding Application No. PCT/JP2011/065599 [with English Translation].

Notice of Allowance dated Jun. 25, 2013 issued in related Korean Application No. 10-2013-7000242 [with English Translation].

Office Action dated Nov. 8, 2013 issued in related U.S. Appl. No. 13/806,457.

Search Report dated Feb. 11, 2014 issued in related European Application No. 11803664.9.

* cited by examiner

NI-ADDED STEEL PLATE AND METHOD OF MANUFACTURING THE SAME

This application is a national stage application of International Application No. PCT/JP2011/072188, filed Sep. 28, 2011, the content of which is incorporated by reference in its entirety.

TECHNICAL FIELD

The present invention relates to a Ni-added steel plate which is excellent in fracture-resisting performance (toughness, arrestability, and unstable fracture-suppressing characteristic described below) of a base metal and a welded joint of a steel plate and a method of manufacturing the same.

BACKGROUND ART

Steels used for a liquefied natural gas (LNG) tank need to have fracture-resisting performance at an extremely low temperature of approximately −160° C. For example, so-called 9% Ni steel is used for the inside tank of the LNG tank. The 9% Ni steel is a steel that contains, by mass %, approximately 8.5% to 9.5% of Ni, has a structure mainly including tempered martensite, and is excellent in, particularly, low-temperature toughness (for example, Charpy impact-absorbed energy at −196° C.). With an increasing demand for natural gas in recent years, in order to satisfy an increase in the size of the LNG tank, there is a demand for additional improvement in the fracture resistance of the tank. As one of the fracture-resisting performances, various techniques to improve the toughness of the 9% Ni steel have been disclosed. For example, Patent Documents 1 to 3 disclose techniques in which temper embrittlement sensitivity is reduced by a two-phase region thermal treatment so as to improve the toughness. In addition, Patent Documents 4 to 6 disclose techniques in which Mo that can increase strength without increasing the temper embrittlement sensitivity is added so as to significantly improve the toughness. However, since the manufacturing costs increase in the methods of Patent Documents 1 to 6, it is difficult to use the methods at a low cost for the LNG tank which has a strong demand for fracture-resisting performance. Meanwhile, steel plates having a plate thickness of 4.5 mm to 80 mm are used as the 9% Ni steel for the LNG tanks. Among them, a steel plate having a plate thickness of 6 mm to 50 mm is mainly used.

CITATION LIST

Patent Literature

[Patent Document 1] Japanese Unexamined Patent Application, First Publication No. H09-143557

[Patent Document 2] Japanese Unexamined Patent Application, First Publication No. 1-04-107219

[Patent Document 3] Japanese Unexamined Patent Application, First Publication No. S56-156715

[Patent Document 4] Japanese Unexamined Patent Application, First Publication No. 2002-129280

[Patent Document 5] Japanese Unexamined Patent Application, First Publication No. H04-371520

[Patent Document 6] Japanese Unexamined Patent Application, First Publication No. S61-133312

SUMMARY OF THE INVENTION

Problem to be Solved by the Invention

An object of the invention is to provide an inexpensive steel plate that is significantly excellent in fracture-resisting performance at approximately −160° C. with a Ni content of approximately 9% and a method of manufacturing the same.

Means for Solving the Problems

The present invention provides a steel plate that is significantly excellent in fracture-resisting performance at approximately −160° C. with a Ni content of approximately 9% and a method of manufacturing the same. An aspect thereof is as follows.

(1) A Ni-added steel plate according to an aspect of the invention includes, by mass %, C: 0.04% to 0.10%, Si: 0.02% to 0.12%, Mn: 0.3% to 1.0%, Ni: more than 7.5% to 10.0%, Al: 0.01% to 0.08%, T.O: 0.0001% to 0.0030%, P: limited to 0.0100% or less, S: limited to 0.0035% or less, N: limited to 0.0070% or less, and the balance consisting of Fe and unavoidable impurities, in which a Ni segregation ratio at an area of ¼ of a plate thickness away from a plate surface in a thickness direction is 1.3 or less, a fraction of austenite after a deep cooling is 0.5% or more, an austenite unevenness index after the deep cooling is 3.0 or less, and an average equivalent circle diameter of the austenite after the deep cooling is 1 μm or less.

(2) The Ni-added steel plate according to the above (1) may further include, by mass %, at least one of Cr: 1.5% or less, Mo: 0.4% or less, Cu: 1.0% or less, Nb: 0.05% or less, Ti: 0.05% or less, V: 0.05% or less, B: 0.05% or less, Ca: 0.0040% or less, Mg: 0.0040% or less, and REM: 0.0040% or less.

(3) In the Ni-added steel plate according to the above (1) or (2), the plate thickness may be 4.5 mm to 80 mm.

(4) A method of manufacturing a Ni-added steel plate according to an aspect of the invention includes performing a first thermomechanical treatment with respect to a steel including, by mass %, C: 0.04% to 0.10%, Si: 0.02% to 0.12%, Mn: 0.3% to 1.0%, Ni: more than 7.5% to 10.0%, Al: 0.01% to 0.08%, T.O: 0.0001% to 0.0030%, P: limited to 0.0100% or less, S: limited to 0.0035% or less, N: limited to 0.0070% or less, and the balance consisting of Fe and unavoidable impurities, in which the steel is held at a heating temperature of 1250° C. or higher and 1380° C. or lower for 8 hours or longer and 50 hours or shorter and thereafter is cooled by an air cooling to 300° C. or lower; performing a second thermomechanical treatment with respect to the steel, in which the steel is heated to 900° C. or higher and 1270° C. or lower, is subjected to a hot rolling at a rolling reduction ratio of 2.0 or more and 40 or less while a temperature at one pass before a final pass is controlled to 660° C. or higher and 900° C. or lower and thereafter is cooled to 300° C. or lower immediately; and performing a third thermomechanical treatment with respect to the steel, in which the steel is heated to 500° C. or higher and 650° C. or lower and thereafter is cooled.

(5) The method of manufacturing the Ni-added steel plate according to the above (4), the steel may further include, by mass %, at least one of Cr: 1.5% or less, Mo: 0.4% or less, Cu: 1.0% or less, Nb: 0.05% or less, Ti: 0.05% or less, V: 0.05% or less, B: 0.05% or less, Ca: 0.0040% or less, Mg: 0.0040% or less, and REM: 0.0040% or less.

(6) In the method of manufacturing the Ni-added steel plate according to the above (4) or (5), in the first thermomechanical treatment, before the air cooling, the steel may be subjected to a hot rolling at a rolling reduction ratio of 1.2 or more and 40 or less while a temperature at one pass before a final pass is controlled to 800° C. or higher and 1200° C. or lower.

(7) In the method of manufacturing the Ni-added steel plate according to the above (4) or (5), in the second thermomechanical treatment, the steel may be cooled to 300° C. or lower immediately after the hot rolling and may be reheated to 780° C. or higher and 900° C. or lower.

(8) In the method of manufacturing the Ni-added steel plate according to the above (4) or (5), in the first thermomechanical treatment, before the air cooling, the steel may be subjected to the hot rolling at the rolling reduction ratio of 1.2 or more and 40 or less while the temperature at one pass before the final pass is controlled 800° C. or higher and 1200° C. or lower, and in the second thermomechanical treatment, the steel may be cooled to 300° C. or lower immediately after the hot rolling and may be reheated to 780° C. or higher and 900° C. or lower.

Effects of the Invention

According to the present invention, it is possible to improve the toughness, arrestability, and unstable fracture-suppressing characteristic of Ni-added steel including approximately 9% of Ni without a significant cost increase. That is, the present invention can inexpensively provide a steel plate equipped with high-level fracture-resisting performance and a method of manufacturing the same, and which has a high industrial value.

DESCRIPTION OF EMBODIMENTS

Figure 1:
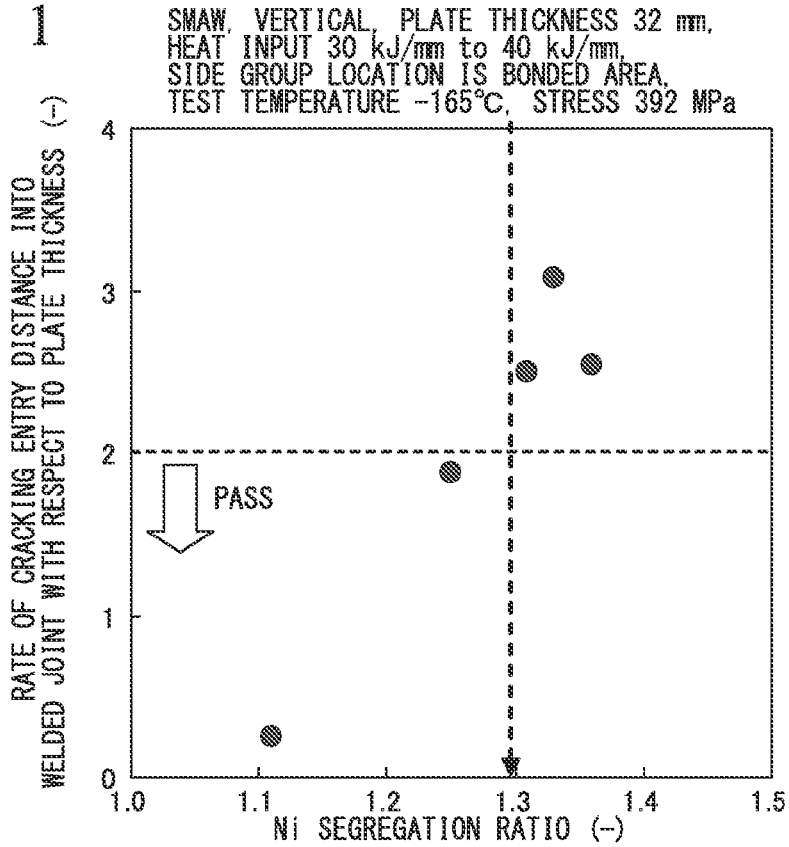
FIG. 1 is a graph showing a relationship between arrestability of a welded joint and a Ni segregation ratio.

The present inventors have found that three kinds of fracture-resisting performance are important as characteristics (characteristics of a base metal and a welded joint) necessary for a steel plate used for a welded structure such as a LNG tank. Hereinafter, as the fracture-resisting performance of the invention, a characteristic that prevents occurrence of brittle fracture (cracking) is defined to be toughness, a characteristic that stops propagation of brittle fracture (cracking) is defined to be arrestability, and a characteristic that suppresses an unstable fracture (fracture type including ductile fracture) at a vicinity where propagation of cracking stopped is defined to be an unstable fracture-suppressing characteristic. The three kinds of fracture-resisting performance are evaluated for both the base metal and the welded joint of the steel plate.

The invention will be described in detail.

At first, a background which resulted in the invention will be described. The inventors thoroughly studied methods of improving fracture-resisting performance, particularly, arrestability at approximately −160° C. to the same level as a steel that has been performed a two-phase region thermal treatment at a high temperature without performing a high-temperature two-phase region thermal treatment on 9% Ni steel (steel including more than 7.5% to 10.0% of Ni).

As a result of the studies, it becomes evident that the unevenness of alloy elements in a steel plate has a large influence on the arrestability of a base metal and a welded joint. In a case that the unevenness of the alloy elements is excessive, in the base metal of steel, the distribution of retained austenite becomes uneven, and a performance that stops the propagation of brittle cracking (arrestability) degrades. In the welded joint of steel, hard martensite is formed in a state where the martensite is concentrated in an island shape in some of an area heated to the two-phase region temperature due to thermal influences of welding, and the performance that stops propagation of brittle cracking (arrestability) significantly degrades.

In general, in a case that fracture characteristics are affected by the unevenness of alloy elements, central segregation in the vicinity of a central area of the steel plate in the plate thickness direction (depth direction) becomes a problem. This is because the brittle central segregation area in a material and the plate-thickness central area where stress triaxiality (stress state) dynamically increases overlap so as to preferentially cause brittle fracture. However, in 9% Ni steel, an austenitic alloy is used as a welding material in most cases. In this case, since a welded joint shape in which the austenitic alloy which does not brittlely fracture is present to a large fraction in the plate-thickness central area is used, there is little possibility of brittle fracture caused by central segregation.

Therefore, the inventors have studied the relationship between micro segregation and fracture performance against brittle fracture (arrestability). As a result, the inventors have obtained extremely important knowledge that micro segregation occurs across the entire thickness of the steel, and thus has a large influence on a performance that stops propagation of brittle fracture (arrestability) through the structural changes of the base metal and a welding heat-affected area. The micro segregation is a phenomenon that an alloy-enriched area is formed in residual molten steel between dendrite secondary arms during solidification, and the alloy-enriched area is extended through rolling. The inventors have succeeded in significantly improving the arrestability of a base metal and the welded joint by carrying out thermomechanical treatments several times under predetermined conditions.

The specific conditions will be described below.

Hereinafter, the ranges of the alloy elements in steel will be specified. Meanwhile, hereinafter, "%" indicates "mass %."

Since C is an essential element for securing strength, the C content is set to 0.04% or more. However, when the C content increases, the toughness and weldability of a base metal degrade due to formation of coarse precipitates, and therefore the upper limit of the C content is set to 0.10%. That is, the C content is limited to 0.04% to 0.10%. Meanwhile, in order to improve strength, the lower limit of the C content may be limited to 0.05% or 0.06%. In order to improve the toughness and weldability of a base metal, the upper limit of the C content may be limited to 0.09%, 0.08%, or 0.07%.

The Si content is important in the invention. When Si is reduced to 0.12% or less, temper embrittlement sensitivity degrades, and the toughness and arrestability of a base metal improve. Therefore, the upper limit of the Si content is set to 0.12%. On the other hand, when the Si content is set to less than 0.02%, refining loads significantly increase. Therefore, the Si content is limited to 0.02% to 0.12%. Meanwhile, when the Si content is set to 0.10% or less or 0.08% or less, the toughness and arrestability of a base metal further improve, and therefore the upper limit of the Si content is preferably set to 0.10% or less or 0.08% or less.

T.O is unavoidably included in steel, and the content thereof is important in the invention. When T.O is reduced to 0.0030% or less, it is possible to significantly improve the toughness and arrestability of a base metal and the toughness of a welded joint. Therefore, the T.O content is limited to 0.0030% or less. On the other hand, when the T.O content is less than 0.0001%, refining loads are extremely high, and thus productivity degrades. Therefore, the TO content is limited to 0.0001% to 0.0030%. Meanwhile, when the T.O content is set to 0.0025% or 0.0015%, the toughness of a base metal significantly improves, and therefore the upper limit of the T.O content is preferably set to 0.0025% or less or 0.0015% or less. Meanwhile, the T.O content is the total of oxygen dissolved in molten steel and oxygen in fine deoxidized products suspended in the molten steel. That is, the T.O content is the total of oxygen that forms a solid solution in steel and oxygen in oxides dispersed in steel.

Mn is an effective element for increasing strength. Therefore, the Mn content which is needed in steel is 0.3% or more at a minimum. Conversely, when the Mn content being included in the steel is more than 1.0%, temper embrittlement sensitivity increases, and thus fracture-resisting performance degrades. Therefore, the Mn content is limited to 0.3% to 1.0%. Meanwhile, in order to suppress temper embrittlement sensitivity by reducing the Mn content, the upper limit of the Mn content may be limited to 0.95%, 0.9% or 0.85%. In a case that a higher strength needs to be secured, the lower limit of the Mn content may be limited to 0.4%, 0.5%, 0.6% or 0.7%.

P is an element that is unavoidably included in steel, and degrades the fracture-resisting performance of a base metal. When the P content is less than 0.0010%, productivity significantly degrades due to an increase in refining loads, and therefore it is not necessary to decrease the content of phosphorous to 0.0010% or less. However, since the effects of the invention can be exhibited even when the P content is 0.0010% or less, it is not particularly necessary to limit the lower limit of the P content, and thus the lower limit of the P content is 0%. When the P content exceeds 0.0100%, the fracture-resisting performance of a base metal degrades due to acceleration of temper embrittlement. Therefore, the P content is limited to 0.0100% or less.

S is an element that is unavoidably included in steel, and degrades the fracture-resisting performance of a base metal. When the S content is less than 0.0001%, productivity significantly degrades due to an increase in refining loads, and therefore it is not necessary to decrease the content of sulfur to less than 0.0001%. However, since the effects of the invention can be exhibited even when the S content is less than 0.0001%, it is not particularly necessary to limit the lower limit of the S content, and thus the lower limit of the S content is 0%. When the S content exceeds 0.0035%, the toughness of a base metal degrades. Therefore, the S content is limited to 0.0035% or less.

Ni is an effective element for improving the fracture-resisting performance of a base metal and a welded joint. When the Ni content is 7.5% or less, the increment of fracture-resisting performance due to stabilization of solute Ni and retained austenite is not sufficient, and when the Ni content exceeds 10.0%, manufacturing costs increase. Therefore, the Ni content is limited to more than 7.5% to 10.0%. Meanwhile, in order to further enhance the fracture-resisting performance, the lower limit of the Ni content may be limited to 7.7%, 8.0%, or 8.5%. In addition, in order to decrease alloying costs, the upper limit of the Ni content may be limited to 9.8%, or 9.5%.

Al is an effective element as a deoxidizer. Since deoxidation is not sufficient when less than 0.01% of Al is included in steel, the toughness of a base metal degrades. When more than 0.08% of Al is included in steel, the toughness of a welded joint degrades. Therefore, the Al content is limited to 0.01% to 0.08%. In order to reliably carry out deoxidation, the lower limit of the Al content may be limited to 0.015%, 0.02%, or 0.025%. In order to improve the toughness of a welded joint, the upper limit of the Al content may be limited to 0.06%, 0.05%, or 0.04%.

N is an element that is unavoidably included in steel, and degrades the fracture-resisting performance of a base metal and a welded joint. When the N content is less than 0.0001%, productivity significantly degrades due to an increase in refining loads, and therefore it is not necessary to carry out nitrogen removal to less than 0.0001%. However, since the effects of the invention can be exhibited even when the N content is less than 0.0001%, it is not particularly necessary to limit the lower limit of the N content, and thus the lower limit of the N content is 0%. When the N content exceeds 0.0070%, the toughness of a base metal and the toughness of a welded joint degrade. Therefore, the N content is limited to 0.0070% or less. In order to improve toughness, the upper limit of the N content may be limited to 0.0060%, 0.0050%, or 0.0045%.

Meanwhile, a chemical composition that includes the above basic chemical components (basic elements) with a balance consisting of Fe and unavoidable impurities is the basic composition of the invention. However, in the invention, the following elements (optional elements) may be further optionally included in addition to the basic composition (instead of some of Fe in the balance). Meanwhile, the effects in the present embodiment are not impaired even when the selected elements are unavoidably incorporated into steel.

Cr is an effective element for increasing strength, and may be optionally added. Therefore, 0.01% or more of Cr is preferably included in steel. Conversely, when more than 1.5%[9] of Cr is included in steel, the toughness of a welded joint degrades. Therefore, when Cr is added, the Cr content is preferably limited to 0.01% to 1.5%. In order to improve the toughness of a welded joint, the upper limit of the Cr content may be limited to 1.3%, 1.0%, 0.9%, or 0.8%. Meanwhile, in order to reduce alloying costs, intentional addition of Cr is not desirable, and thus the lower limit of Cr is 0%.

Mo is an effective element for increasing strength without increasing temper embrittlement sensitivity, and may be optionally added. When the Mo content is less than 0.01%, an effect of increasing strength is small, and when the Mo content exceeds 0.4%, manufacturing costs increase while degrading the toughness of a welded joint. Therefore, when Mo is added, the Mo content is preferably limited to 0.01% to 0.4%. In order to improve the toughness of a welded joint, the upper limit of the Mo content may be limited to 0.35%, 0.3%, or 0.25%. Meanwhile, in order to reduce alloying costs, intentional addition of Mo is not desirable, and thus the lower limit of Mo is 0%.

Cu is an effective element for improving strength, and may be optionally added. An effect of improving the strength of a base metal is small when less than 0.01% of Cu is included in steel. When more than 1.0% of Cu is included in steel, the toughness of a welded joint degrades. Therefore, when Cu is added, the Cu content is preferably limited to 0.01% to 1.0%. In order to improve the toughness of a welded joint, the upper limit of the Cu content may be limited to 0.5%, 0.3%, 0.1%, or 0.05%. Meanwhile, in order to reduce alloying costs, intentional addition of Cu is not desirable, and thus the lower limit of Cu is 0%.

Nb is an effective element for improving strength, and may be optionally added. An effect of improving the strength of a base metal is small when less than 0.001% of Nb is included in steel. When more than 0.05% of Nb is included in steel, the toughness of a welded joint degrades. Therefore, when Nb is added, the Nb content is preferably limited to 0.001% to 0.05%. Meanwhile, in order to reduce alloying costs, intentional addition of Nb is not desirable, and thus the lower limit of Nb is 0%.

Ti is an effective element for improving the toughness of a base metal, and may be optionally added. An effect of improving the toughness of a base metal is small when less than 0.001% of Ti is included in steel. In a case that Ti is added, when more than 0.05% of Ti is included in steel, the toughness of a welded joint degrades. Therefore, the Ti content is preferably limited to 0.001% to 0.05%. In order to improve the toughness of a welded joint, the upper limit of the Ti content may be limited to 0.03%, 0.02%, 0.01%, or 0.005%. Meanwhile, in order to reduce alloying costs, intentional addition of Ti is not desirable, and thus the lower limit of Ti is 0%.

V is an effective element for improving the strength of base metal, and may be optionally added. An effect of improving the strength of a base metal is small when less than 0.001% of V is included in steel. When more than 0.05% of V is included in steel, the toughness of a welded joint degrades. Therefore, when V is added, the V content is preferably limited to 0.001% to 0.05%. In order to improve the toughness of a welded joint, the upper limit of the V content may be limited to 0.03%, 0.02%, or 0.01%. Meanwhile, in order to reduce alloying costs, intentional addition of V is not desirable, and thus the lower limit of V is 0%.

B is an effective element for improving the strength of a base metal, and may be optionally added. An effect of improving the strength of a base metal is small when less than 0.0002% of B is included in steel. When more than 0.05% of B is included in steel, the toughness of a base metal degrades. Therefore, when B is added, the B content is preferably limited to 0.0002% to 0.05%. In order to improve the toughness of a base metal, the upper limit of the B content may be limited to 0.03%, 0.01%, 0.003%, or 0.002%. Meanwhile, in order to reduce alloying costs, intentional addition of B is not desirable, and thus the lower limit of B is 0%.

Ca is an effective element for preventing the clogging of a nozzle, and may be optionally added. An effect of preventing the clogging of the nozzle is small when less than 0.0003% of Ca is included in steel. When more than 0.0040% of Ca is included in steel, the toughness of a base metal degrades. Therefore, when Ca is added, the Ca content is preferably limited to 0.0003% to 0.0040%. In order to prevent degradation of the toughness of a base metal, the upper limit of the Ca content may be limited to 0.0030%, 0.0020%, or 0.0010%. Meanwhile, in order to reduce alloying costs, intentional addition of Ca is not desirable, and thus the lower limit of Ca is 0%.

Mg is an effective element for improving toughness, and may be optionally added. An effect of improving the strength of a base metal is small when less than 0.0003% of Mg is included in steel. When more than 0.0040% of Mg is included in steel, the toughness of a base metal degrades. Therefore, when Mg is added, the Mg content is preferably limited to 0.0003% to 0.0040%. In order to prevent degradation of the toughness of a base metal, the upper limit of the Mg content may be limited to 0.0030%, 0.0020%, or 0.0010%. Meanwhile, in order to reduce alloying costs, intentional addition of Mg is not desirable, and thus the lower limit of Mg is 0%.

REM (rare earth metal: at least one selected from 17 elements of Sc, Y, and lanthanoid series) are effective elements for preventing the clogging of a nozzle, and may be optionally added. An effect of preventing the clogging of the nozzle is small when less than 0.0003% of REM is included in steel. When more than 0.0040% of REM is included in steel, the toughness of a base metal degrades. Therefore, when REM is added, the REM content is preferably limited to 0.0003% to 0.0040%. In order to prevent degradation of the toughness of a base metal, the upper limit of the REM content may be limited to 0.0030%, 0.0020%, or 0.0010%. Meanwhile, in order to reduce alloying costs, intentional addition of REM is not desirable, and thus the lower limit of REM is 0%.

Meanwhile, elements that may be incorporated, which are as unavoidable impurities in raw materials that include the additive alloy to be used and are as unavoidable impurities that are eluted from heat-resistant materials such as furnace materials during melting, may be included in steel at less than 0.002%. For example, Zn, Sn, Sb, and Zr which can be incorporated while melting steel may be included in steel at less than 0.002% respectively (since Zn, Sn, Sb, and Zr are unavoidable impurities incorporated according to the melting conditions of steel, the content may be 0%). Effects of the invention are not impaired even when the above elements are included in steel at less than 0.002% respectively.

As described above, the Ni-added steel plate according to the invention has a chemical composition including the above basic elements with the balance consisting of Fe and unavoidable impurities, or a chemical composition including the above basic elements and at least one selected from the above selected elements with the balance consisting of Fe and unavoidable impurities.

In the invention, as described above, uniform distribution of solute elements in steel is extremely important. Specifically, reduction of the banded microsegregation of solute elements such as Ni is effective for improvement of the arrestability of a base metal and a welded joint. The banded micro segregation refers to a banded form (banded area) where an area that solute elements concentrated in residual molten steel between dendrite arms at the time of solidification are extended in parallel in a rolling direction through hot rolling. That is, in the banded micro segregation (banded segregation), an area where solute elements are concentrated and an area where solute elements are not concentrated are alternately formed in a band shape at intervals of, for example, 1 μm to 100 μm. Unlike central segregation that is formed at a central area of a slab, in general (for example, at room temperature), the banded micro segregation, does not act as a major cause of a decrease in toughness. However, in steels which are used at an extremely low temperature of −160° C., the banded segregation has an extremely large influence. When solute elements such as Ni, Mn, and P are unevenly present in steel due to the banded segregation, the stability of retained austenite generated during a thermomechanical treatment significantly varies depending on places (locations in steel). Therefore, in a base metal, the performance that stops propagation of brittle fracture (arrestability) significantly degrades. In addition, in the case of a welded joint, when banded areas where solute elements such as Ni, Mn, and P are concentrated are affected by welding heat, martensite islands packed along the banded area is generated. Since the martensite islands occur low stress fracture, the arrestability of the welded joint degrades.

The inventors firstly have investigated the relationship between Ni segregation ratios and the arrestability of a welded joint. As a result, it is found that, when the Ni segregation ratio at a position of ¼ of the plate thickness away from the steel plate surface in the plate thickness central (depth) direction (hereinafter referred to as the ¼t area) is 1.3 or less, the arrestability of a welded joint is excellent. Therefore, the Ni segregation ratio at the ¼t area is limited to 1.3 or less. Meanwhile, when the Ni segregation ratio at the ¼t area is 1.15 or less, the arrestability of a welded joint is superior, and therefore the Ni segregation ratio is preferably set to 1.15 or less.

The Ni segregation ratio at the ¼t area can be measured by electron probe microanalysis (EPMA). That is, the Ni contents are measured by EPMA at intervals of 2 μm across a length of 2 mm in the plate thickness direction centered on a location which is ¼ of the plate thickness away from the steel plate surface (plate surface) in the plate thickness direction (plate thickness central direction, depth direction). Among 1000 data of Ni contents measurement data, the 10 data of the Ni contents measurement data in descending order and the 10 data of the Ni contents measurement data in ascending order are excluded from evaluation data as abnormal values. The average of the remaining data at 980 places is defined to be the average value of the Ni content. Among the data at 980 places, the average of the 20 data of the highest Ni content is defined to be the maximum value of the Ni content. A value that the maximum value of the Ni content divided by the average value of the Ni content is defined to be the Ni segregation ratio at the ¼t area. The lower limit value of the Ni segregation ratio statistically becomes 1.0. Therefore, the lower limit of the Ni segregation ratio may be 1.0. Meanwhile, in the invention, when the result (CTOD value δc) of a crack tip opening displacement (CTOD) test of a welded joint at −165° C. is 0.3 mm or more, the toughness of the welded joint is evaluated to be excellent. In addition, in a duplex ESSO test of a welded joint which is carried out under conditions of a test temperature of −165° C. and a load stress of 392 MPa, when the entry distance of brittle cracking into a test plate is twice of or less than the plate thickness, the arrestability of the welded joint is evaluated to be excellent. In contrast, when brittle cracking stops in the middle of the test plate, but the entry distance of the brittle cracking into the test plate is twice of or more than the plate thickness and when brittle cracking penetrates the test plate, the arrestability of the welded joint is evaluated to be poor.

FIG. 1 shows the relationship between the Ni segregation ratio and the rate of the cracking entry distance in the plate thickness (measured values of the duplex ESSO test under the above conditions). As shown in FIG. 1, when the Ni segregation ratio is 1.3 or less, the cracking entry distance becomes twice of or less than the plate thickness and thus the arrestability of the welded joint is excellent. The welded joint used in the duplex ESSO test of FIG. 1 is manufactured under the following conditions using shield metal arc welding (SMAW). That is, the SMAW is carried out by vertical welding under conditions of a heat input of 3.0 kJ/cm to 4.0 kJ/cm and a preheating temperature and an interlayer temperature of 100° C. or lower. Meanwhile, a notch is located at a weld bond.

Figure 2:
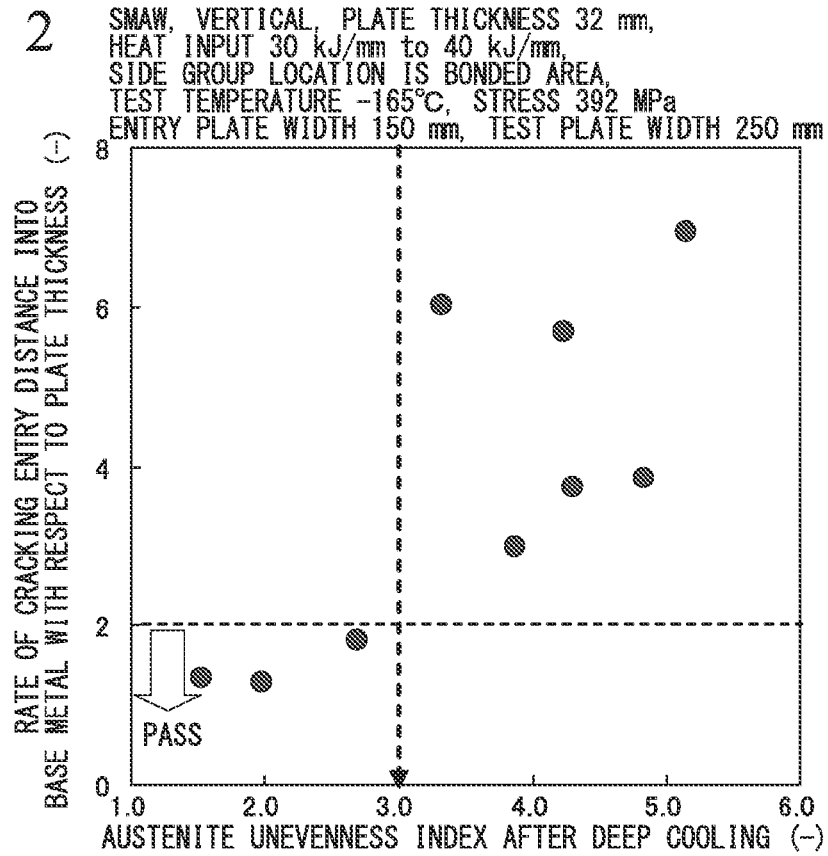
FIG. 2 is a graph showing a relationship between arrestability of a base metal and an austenite unevenness index after deep cooling.

Next, the inventors investigated the relationship between retained austenite after deep cooling and the arrestability of a base metal. That is, the inventors define the ratio of the maximum area fraction to the minimum area fraction of the retained austenite after deep cooling as an austenite unevenness index after deep cooling (hereinafter sometimes also referred to as the unevenness index), and investigate the relationship between the index and the arrestability of a base metal. As a result of the duplex ESSO test of a base metal, the relationship between the arrestability of a base metal and the austenite unevenness index after deep cooling as shown in FIG. 2 is obtained. As shown in FIG. 2, it has been found that, when the austenite unevenness index after deep cooling exceeds 3, the arrestability of the base metal degrades (the entry distance of the brittle cracking into the test plate becomes twice of or more than the plate thickness). Therefore, in the invention, the austenite unevenness index after deep cooling is limited to 3.0 or less. The lower limit of the austenite unevenness index after deep cooling is statistically 1. Therefore, the austenite unevenness index after deep cooling in the invention may be 1.0 or more. Meanwhile, the maximum area fraction and minimum area fraction of austenite can be evaluated from the electron back scattering pattern (EBSP) of a sample which is deep-cooled in liquid nitrogen. Specifically, the area fraction of austenite is evaluated by mapping the EBSP in a 5 m×5 μm area. The area fraction is continuously evaluated at a total of 40 fields centered on a location which is the ¼t area of the steel plate in the plate thickness direction. Among the data at all 40 fields, the average of the 5 data with the largest area fractions of austenite is defined to be the maximum area fraction, and the average of the 5 data with the smallest area fractions of austenite is defined to be the minimum area, fraction. Furthermore, a value obtained by dividing the above maximum area fraction by the minimum area fraction is defined to be the austenite unevenness index after deep cooling. Meanwhile, since it is not possible to investigate the above micro unevenness of austenite by X-ray diffraction described below, EBSP is used.

Figure 3:
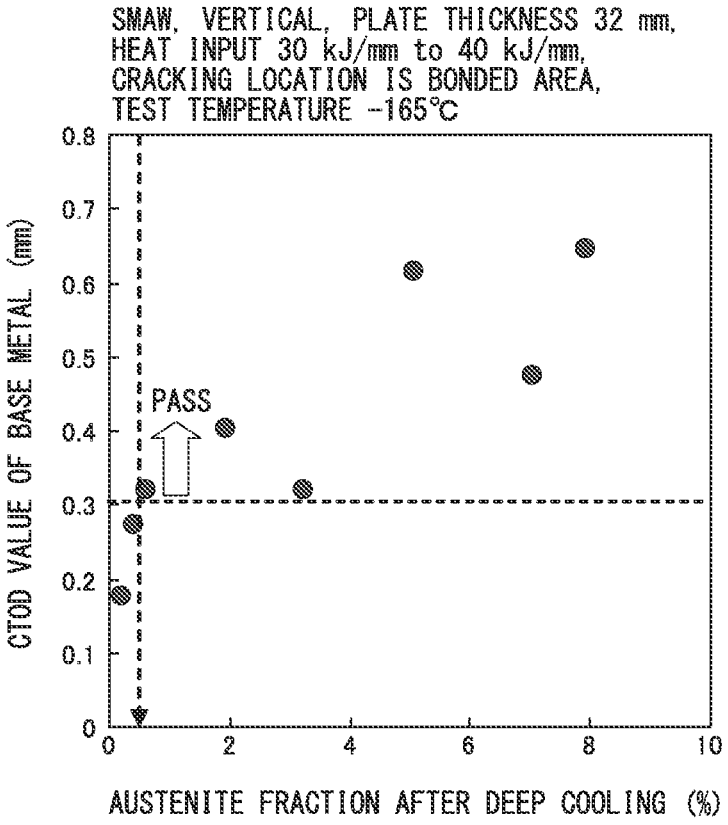
FIG. 3 is a graph showing a relationship between toughness of a base metal and a fraction of austenite after deep cooling.

The absolute amount of the retained austenite is also important. FIG. 3 shows the relationship between the toughness (CTOD value) of a base metal, which is obtained by the CTOD test, and the fraction of austenite after the deep cooling. As illustrated in FIG. 3 as an example, when the fraction of the retained austenite after deep cooling (hereinafter sometimes also referred to as the fraction of austenite) is below 0.5% of the fraction of the entire structure, the toughness and arrestability of a base metal significantly degrade. Therefore, the fraction of austenite after deep cooling is 0.5% or more. In addition, when the fraction of the retained austenite after deep cooling significantly increases, the austenite becomes unstable under plastic deformation, and, conversely, the toughness and arrestability of a base metal degrade. Therefore, the fraction of austenite after deep cooling is preferably 0.5% to 20%. Meanwhile, the fraction of the retained austenite after deep cooling can be measured by deep cooling a sample taken from the ¼t area of a steel plate in liquid nitrogen for hour, and then carrying out X-ray diffraction on the sample at room temperature. Meanwhile, in the present invention, a treatment that a sample is immersed in liquid nitrogen and held for at least 1 hour is referred to as a deep cooling treatment.

It is also extremely important that the retained austenite be fine. Even when the fraction of the retained austenite after deep cooling is 0.5% to 20%, and the unevenness index is 1.0 to 3.0, if the retained austenite is coarse, unstable fracture is liable to occur at the welded joint. When once-stopped cracking propagates again across the entire cross-section in the plate thickness direction due to an unstable fracture, the base metal is included in some of the propagation path of the cracking. Therefore, when the stability of austenite in the base metal decreases, an unstable fracture becomes liable to occur. That is, when the retained austenite becomes coarse, the C content included in the retained austenite decreases, and therefore the stability of the retained austenite degrades. When the average of the equivalent circle diameter (average equivalent circle diameter) of the retained austenite after deep cooling is 1 μm or more, an unstable fracture becomes liable to occur. Therefore, in order to obtain a sufficient unstable fracture-suppressing characteristic, the average equivalent circle diameter of the retained austenite after deep cooling is limited to 1 μm or less. Meanwhile, an unstable fracture (unstable ductile fracture) is a phenomenon that brittle fracture occurs, propagates, then stops, and then the fracture propagates again. The forms of the unstable fracture include a case that the entire fractured surface is a ductile-fractured surface, and a case that the surfaces in the vicinity of both ends (both surfaces) of the plate thickness in the fractured surface are ductile-fractured surfaces, and the surface in the vicinity of the central area of the plate thickness in the fractured surface is a brittle-fractured surface. Meanwhile, the average equivalent circle diameter of the austenite after deep cooling can be obtained by, for example, observing dark-field images at 20 places using a transmission electron microscope at a magnification of 10000 times, and quantifying the average equivalent circle diameter. The lower limit of the average equivalent circle diameter of the austenite after deep cooling may be, for example, 1 nm.

Therefore, the steel plate of the invention is excellent in fracture-resisting performance at approximately −160° C., and can be used for general welded structures such as ships, bridges, constructions, offshore structures, pressure vessels, tanks, and line pipes. Particularly, the steel plate of the invention is effective when the steel plate is used as an LNG tank which demands fracture-resisting performance at an extremely low temperature of approximately −160° C.

Next, the method of manufacturing a Ni-added steel plate of the invention will be described. In a first embodiment of the method of manufacturing a Ni-added steel plate of the invention, a steel plate is manufactured through a manufacturing process including a first thermomechanical treatment (band segregation reduction treatment), a second thermomechanical treatment (hot rolling and a controlled cooling treatment), and a third thermomechanical treatment (low-temperature two-phase region treatment). Furthermore, as described in a second embodiment of the method of manufacturing a Ni-added steel plate of the invention, in the first thermomechanical treatment (band segregation reduction treatment), hot rolling may be performed after a thermal treatment (heating) as described below. Additionally, as described in a third embodiment of the method of manufacturing a Ni-added steel plate of the invention, in the second thermomechanical treatment (hot rolling and a controlled cooling treatment), a reheating treatment may be performed before the controlled cooling as described below. Here, a process that treatments such as hot rolling and controlled cooling are optionally combined with respect to a thermal treatment at a high temperature which is a basic treatment according to necessity is defined to be the thermomechanical treatment. In addition, a billet (steel) within a range of the above alloy elements (the above steel components) is used in the first thermomechanical treatment.

Hereinafter, the first embodiment of the method of manufacturing a Ni-added steel plate of the invention will be described.

First Embodiment

Firstly, the first thermomechanical treatment (band segregation reduction treatment) will be described. The thermomechanical treatment can reduce the segregation ratio of solute elements and uniformly disperse the stable retained austenite in steel even after deep cooling so as to enhance the arrestability of a base metal and a welded joint. In the first thermomechanical treatment (band segregation reduction treatment), a thermal treatment is performed at a high temperature for a long period of time. The inventors have investigated the influence of a combination of the heating temperature and holding time of the first thermomechanical treatment (band segregation reduction treatment) on the Ni segregation ratio and the austenite unevenness index. As a result, it has been found that, in order to obtain a steel plate having a Ni segregation ratio at the ¼t area of 1.3 or less and an austenite unevenness index after deep cooling of 3 or less, it is necessary to hold a slab for 8 hours or longer at a heating temperature of 1250° C. or higher. Therefore, in the first thermomechanical treatment (band segregation reduction treatment), the heating temperature is 1250° C. or higher, and the holding time is 8 hours or longer. Meanwhile, when the heating temperature is set to 1380° C. or higher, and the holding time is set to 50 hours, productivity significantly degrades, and therefore the heating temperature is controlled to 1380° C. or lower, and the holding time is limited to 50 hours or shorter. Meanwhile, when the heating temperature is set to 1300° C. or higher, and the holding time is set to 30 hours or longer, the Ni segregation ratio and the austenite unevenness index further decrease. Therefore, the heating temperature is preferably 1300° C. or higher, and the holding time is preferably 30 hours or longer. In the first thermomechanical treatment, a billet having the above steel components is heated, held under the above conditions, and then performed air cooling. When the temperature at which the process moves from the air cooling to the second thermomechanical treatment (hot rolling and a controlled cooling treatment) exceeds 300° C., transformation is not completed, and thus material qualities become uneven. Therefore, the surface temperature (end temperature of air cooling) of a billet at the time of moving the process from the air cooling to the second thermomechanical treatment (hot rolling and a controlled cooling treatment) is 300° C. or lower. The lower limit of the end temperature of the air cooling is not particularly limited. For example, the lower limit of the end temperature of the air cooling may be room temperature, or may be −40° C. Meanwhile, the heating temperature refers to the temperature of the surface of a slab, and the holding time refers to a held time at the heating temperature after the surface of the slab reaches the set heating temperature, and 3 hours elapses. In addition, the air cooling refers to cooling at a cooling rate of 3° C./s or slower while the temperature at the ¼t area in the steel plate is from 800° C. to 500° C. In the air cooling, the cooling rate at higher than 800° C. or at lower than 500° C. is not particularly limited. The lower limit of the cooling rate of the air cooling may be, for example, 0.01° C./s or faster from the viewpoint of productivity.

Next, the second thermomechanical treatment (hot rolling and a controlled cooling treatment) will be described. In the second thermomechanical treatment, heating, hot rolling (second hot rolling), and controlled cooling are performed. The treatment can generate a quench texture so as to increase strength and miniaturize the structure. Additionally, the unstable fracture-suppressing performance of a welded joint can be enhanced by generating fine stable austenite through introduction of working strains. In order to generate fine stable austenite, control of the rolling temperature is important. When the temperature at one pass before the final pass in the hot rolling becomes low, residual strains increase in steel, and the average equivalent circle diameter of the retained austenite decreases. As a result of investigating the relationship between the average equivalent circle diameter of the retained austenite and the temperature at one pass before the final pass, the inventors have found that the average equivalent circle diameter becomes 1 μm or less by controlling a temperature at one pass before the final pass to be 900° C. or lower. In addition, when the temperature at one pass before the final pass is 660° C. or higher, the hot rolling can be efficiently performed without degrading productivity. Therefore, the temperature at one pass before the final pass in the hot rolling of the second thermomechanical treatment is 660° C. to 900° C. Meanwhile, when the temperature at one pass before the final pass is controlled to 660° C. to 800° C., since the average equivalent circle diameter of the retained austenite further decreases, the temperature at one pass before the final pass is preferably 660° C. to 800° C. Meanwhile, the temperature at one pass before the final pass refers to the temperature of the surface of a slab (billet) measured immediately before biting (the slab biting into a rolling roll) at the final pass in the rolling (hot rolling). The temperature at one pass before the final pass can be measured using a thermometer such as a radiation thermometer.

It is also important to control the heating temperature before the hot rolling in the second thermomechanical treatment (hot rolling and a controlled cooling treatment) in order to secure the austenite content. The inventors have found that, when the heating temperature is set to higher than 1270° C., the fraction of austenite after the deep cooling decreases, and the toughness and arrestability of the base metal significantly degrade. In addition, when the heating temperature is lower than 900° C., productivity significantly degrades. Therefore, the heating temperature is 900° C. to 1270° C. Meanwhile, when the heating temperature is set to 1120° C. or lower, the toughness of the base metal can be more enhanced. Therefore, the heating temperature is preferably 900° C. to 1120° C. The holding time after the heating is not particularly limited. However, the holding time at the above heating temperature is preferably 2 hours to 10 hours from the viewpoint of uniform heating and securing productivity. Meanwhile, the above hot rolling may begin within the holding time.

The rolling reduction ratio of the hot rolling in the second thermomechanical treatment (hot rolling and a controlled cooling treatment) is also important. When the rolling reduction ratio increases, through recrystallization or an increase of dislocation density, the structure after the hot rolling is miniaturized and thus austenite (retained austenite) is also miniaturized. As a result of investigating the relationship between the equivalent circle diameter of austenite after the deep cooling and the rolling reduction ratio, the inventors have found that the rolling reduction ratio needs to be 2.0 or more in order to obtain an average equivalent circle diameter of austenite of 1 μm or less. In addition, when the rolling reduction ratio exceeds 40, productivity significantly degrades. Therefore, the rolling reduction ratio of the hot rolling in the second thermomechanical treatment is 2.0 to 40. Meanwhile, the average equivalent circle diameter of austenite further decreases when the rolling reduction ratio of the hot rolling in the second thermomechanical treatment is 10 or more. Therefore, the rolling reduction ratio is preferably 10 to 40. Meanwhile, the rolling reduction ratio in the hot rolling is a value that the plate thickness before the rolling is divided by the plate thickness after the rolling.

After the hot rolling in the second thermomechanical treatment (hot rolling and a controlled cooling treatment), the controlled cooling of a steel plate (steel) is immediately performed. In the invention, the controlled cooling refers to cooling that is controlled for texture control, and includes accelerated cooling by water cooling and cooling by air cooling with respect to a steel plate having a plate thickness of 15 mm or less. When the controlled cooling is performed by water cooling, the cooling preferably ends at 200° C. or lower. The lower limit of the end temperature of water cooling is not particularly limited. For example, the lower limit of the end temperature of water cooling may be room temperature, or may be −40° C. When a quench texture is generated by performing the controlled cooling immediately, the strength of a base metal can be sufficiently secured. Meanwhile, herein, "immediately" means that, after biting of the final pass of the rolling, the accelerated cooling preferably begins within 150 seconds, and the accelerated cooling more preferably begins within 120 seconds or within 90 seconds. When the surface temperature of the steel plate is lower than or equal to Ar3 that is the temperature at the start time of the transformation, there is a concern that the strength or toughness in the vicinity of the surface layer of the steel plate may degrade. Therefore, cooling preferably begins when the surface temperature of the steel plate is Ar3 or higher. In addition, the strength of a base metal can be more reliably secured when the water cooling ends at 200° C. or lower. In addition, the water cooling refers to cooling that a cooling rate at the ¼t area in the steel plate is faster than 3° C./s. The upper limit of the cooling rate of the water cooling does not need to be particularly limited. When the controlled cooling is performed by the air cooling, the end temperature of cooling in the second thermomechanical treatment (that is, a temperature that reheating starts for the third thermomechanical treatment) is preferably set to 200° C. or lower.

In this way, in the second thermomechanical treatment, the billet after the first thermomechanical treatment is heated to the above heating temperature, and the temperature at one pass before the final pass is controlled to be within the above temperature range so that the hot rolling is performed at the above rolling reduction ratio, and the controlled cooling is then immediately performed.

Next, the third thermomechanical treatment (low-temperature two-phase region treatment) will be described. In the low-temperature two-phase region treatment, the toughness of a base metal is improved because of tempering of martensite. Furthermore, in the low-temperature two-phase region treatment, since thermally stable and fine austenite is generated, and then the austenite is stably present even at room temperature, fracture-resisting performance (particularly, the toughness and arrestability of the base metal, and the unstable fracture-suppressing characteristic of the welded joint) improves. When the heating temperature in the low-temperature two-phase region treatment is below 500° C., the toughness of the base metal degrades. In addition, when the heating temperature in the low-temperature two-phase region treatment exceeds 650° C., the strength of the base metal is not sufficient. Therefore, the heating temperature in the low-temperature two-phase region treatment is 500° C. to 650° C. Meanwhile, after the heating in the low-temperature two-phase region treatment, any cooling of air cooling and water cooling can be performed. In this cooling, it may be combined the air cooling and the water cooling. In addition, the water cooling refers to cooling that a cooling rate at the ¼t area in a steel plate is faster than 3° C./s. The upper limit of the cooling rate of the water cooling is not particularly limited. In addition, the air cooling refers to cooling that a cooling rate is 3° C./s or slower, when the temperature at the ¼t area in the steel plate is from 800° C. to 500° C. In the air cooling, it is not necessary to particularly limit the cooling rate at higher than 800° C. or at lower than 500° C. The lower limit of the cooling rate of the air cooling may be, for example, 0.01° C./s or faster from the viewpoint of productivity. The end temperature of the cooling of the water cooling in the third thermomechanical treatment does not need to be particularly limited, but may be set to 500° C. or lower or 300° C. or lower.

In this way, in the third thermomechanical treatment, the slab after the second thermomechanical treatment is heated to the above heating temperature and cooled.

Thus far, the first embodiment has been described.

In addition, hereinafter, the second embodiment of the method of manufacturing a Ni-added steel plate of the invention will be described.

Second Embodiment

In the first thermomechanical treatment (band segregation reduction treatment) in the second embodiment, the evenness of the solutes can be further enhanced, and then fracture-resisting performance can be significantly improved by performing the hot rolling (the first hot rolling) subsequent to a thermal treatment (heating). Here, it becomes necessary to specify the heating temperature, the holding time, the rolling reduction ratio in the hot rolling, and the rolling temperature of the hot rolling in the first thermomechanical treatment (band segregation reduction treatment). Regarding the heating temperature and the holding time, as the temperature increases or as the holding time increases, the Ni segregation ratio decreases due to diffusion. The inventors have investigated the influence of the combination of the heating temperature and the holding time in the first thermomechanical treatment (band segregation reduction treatment) on the Ni segregation ratio. As a result, it has been found that, in order to obtain a steel plate that a Ni segregation ratio at the ¼t area is 1.3 or less, it is necessary to hold a slab for 8 hours or longer at a heating temperature of 1250° C. or higher. Therefore, in the first thermomechanical treatment, the heating temperature is 1250° C. or higher, and the holding time is 8 hours or longer. Meanwhile, when the heating temperature is set to 1380° C. or higher and the holding time is set to 50 hours or longer, productivity significantly degrades, and therefore the heating temperature is limited to 1380° C. or lower, and the holding time is limited to 50 hours or shorter. Meanwhile, when the heating temperature is set to 1300° C. or higher, or the holding time is set to 30 hours or longer, the Ni segregation ratio further decreases. Therefore, the heating temperature is preferably 1300° C. or higher, and the holding time is preferably 30 hours or longer. Meanwhile, the hot rolling may begin within the holding time.

In the first thermomechanical treatment (band segregation reduction treatment) in the second embodiment, the segregation reduction effect can be expected during rolling and during air cooling after the rolling. That is, when recrystallization occurs, a segregation reduction effect is generated due to grain boundary migration, and when recrystallization does not occur, a segregation reduction effect is generated due to diffusion at a high dislocation density. Therefore, the banded Ni segregation ratio decreases as the rolling reduction ratio increases during the hot rolling. As a result of investigating the influence of the rolling reduction ratio of the hot rolling on the segregation ratio, the inventors have found that it is effective to set the rolling reduction ratio to 1.2 or more in order to achieve a Ni segregation ratio of 1.3 or less. In addition, when the rolling reduction ratio exceeds 40, productivity significantly degrades. Therefore, in the second embodiment, the rolling reduction ratio of the hot rolling in the first thermomechanical treatment (band segregation reduction treatment) is 1.2 to 40. In addition, when the rolling reduction ratio is 2.0 or more, the segregation ratio further decreases, and therefore the rolling reduction ratio is preferably 2.0 to 40. When it is considered that the hot rolling is performed in the second thermomechanical treatment, the rolling reduction ratio of the hot rolling in the first thermomechanical treatment is more preferably 10 or less.

In the first thermomechanical treatment (band segregation reduction treatment) in the second embodiment, it is also extremely important to control the temperature at one pass before the final pass in the hot rolling to an appropriate temperature. When the temperature at one pass before the final pass is too low, diffusion does not proceed during the air cooling after the rolling, and then the Ni segregation ratio increases. Conversely, when the temperature at one pass before the final pass is too high, the dislocation density rapidly decreases due to recrystallization, the diffusion effect at a high dislocation density during the air cooling after the end of the rolling degrades, and then the Ni segregation ratio increases. In the hot rolling of the first thermomechanical treatment (band segregation reduction treatment) in the second embodiment, a temperature region where dislocations appropriately remain in the steel and the diffusion easily proceeds is present. As a result of investigating the relationship between the temperature at one pass before the final pass in the hot rolling and the Ni segregation ratio, the inventors have found that the Ni segregation ratio extremely increases at lower than 800° C. or at higher than 1200° C. Therefore, in the second embodiment, the temperature at one pass before the final pass in the hot rolling of the first thermomechanical treatment (band segregation reduction treatment) is 800° C. to 1200° C. Meanwhile, when the temperature at one pass before the final pass is 950° C. to 1150° C., the segregation ratio reduction effect is further enhanced, and therefore the temperature before the final pass in the hot rolling of the first thermomechanical treatment (band segregation reduction treatment) is preferably 950° C. to 1150° C. After the hot rolling, air cooling is performed. As the diffusion of substitutional solutes (for example, Ni) further proceeds through the air cooling after the rolling, and then segregation decreases. Meanwhile, when the temperature that the process moves from the air cooling after the rolling to the second thermomechanical treatment (hot rolling and a controlled cooling treatment) exceeds 300° C., a transformation is not completed, and then material qualities become uneven. Therefore, the surface temperature (end temperature of air cooling) of a billet at the time of moving the process from the air cooling after rolling to the second thermomechanical treatment (hot rolling and a controlled cooling treatment) is 300° C. or lower. The lower limit of end temperature of the air cooling is not particularly limited. For example, the lower limit of end temperature of the air cooling may be room temperature, or may be −40° C. Meanwhile, the heating temperature refers to the temperature of the surface of a slab, and the holding time refers to a held time at the heating temperature after the surface of the slab reaches the set heating temperature, and 3 hours elapses. The rolling reduction ratio is a value that the plate thickness before the rolling is divided by the plate thickness after the rolling. In the second embodiment, the rolling reduction ratio is calculated with respect to the hot rolling in each of the thermomechanical treatments. In addition, the temperature at one pass before the final pass is the temperature of the surface of a slab that is measured immediately before biting (the slab biting into a rolling roll) of the final pass of the rolling, and can be measured using a thermometer such as a radiation thermometer. The air cooling refers to cooling at a cooling rate of 30° C./s or slower while the temperature at the ¼t area in the steel plate is from 800° C. to 500° C. In the air cooling, the cooling rate at higher than 800° C. or at lower than 500° C. is not particularly limited. The lower limit of the cooling rate of the air cooling may be, for example, 0.01° C./s or faster from the viewpoint of productivity.

After the first thermomechanical treatment (band segregation reduction treatment), similarly to the first embodiment, the second thermomechanical treatment (hot rolling and a controlled cooling treatment) and the third thermomechanical treatment (low-temperature two-phase region treatment) are performed. Therefore, the second thermomechanical treatment (hot rolling and a controlled cooling treatment) and the third thermomechanical treatment (low-temperature two-phase region treatment) will not be described.

Thus far, the second embodiment has been described.

In addition, hereinafter, the third embodiment of the method of manufacturing a Ni-added steel plate according to the invention will be described.

Third Embodiment

In the second thermomechanical treatment (hot rolling and a controlled cooling treatment) in the third embodiment, heating, reheating after hot rolling and air cooling, and controlled cooling can be performed instead of heating and controlled cooling after hot rolling. From the viewpoint of productivity, after hot rolling, air cooling is preferable. The inventors have found that, when the reheating temperature is 900° C. or lower, the structure can be miniaturized and then the toughness and arrestability of a base metal are excellent. In addition, when the reheating temperature decreases, there are cases that productivity degrades. However, the productivity can be sufficiently secured when the reheating temperature is 780° C. or higher. Therefore, in the third embodiment, the reheating temperature in the second thermomechanical treatment (hot rolling and a controlled cooling treatment) is 780° C. to 900° C. immediately after reheating, controlled cooling is performed. When controlled cooling is immediately performed, a quench texture is generated and then the strength of the base metal can be secured. In addition, as described above, in a case that the controlled cooling is performed as accelerated cooling by water cooling, when the water cooling ends at 200° C. or lower, it is possible to more reliably secure the strength of the base metal. For example, the lower limit of the end temperature of the water cooling may be room temperature, or may be −40° C. Meanwhile, herein, "immediately" means that, after the reheating, the accelerated cooling preferably begins within 150 seconds, and the accelerated cooling more preferably begins within 120 seconds or within 90 seconds. When the surface temperature of the steel plate is lower than or equal to Ar3 that is the temperature at the start time of the transformation, there is a concern that the strength or toughness in the vicinity of the surface layer of the steel plate may degrade. Therefore, cooling preferably begins when the surface temperature of the steel plate is Ar3 or higher. In addition, the water cooling refers to cooling that a cooling rate at the ¼t area in the steel plate is faster than 3° C./s. The upper limit of the cooling rate of the water cooling does not need to be particularly limited. In the second thermomechanical treatment, the end temperature of cooling before reheating which is from 780° C. to 900° C. (that is, a temperature that the reheating begins) does not need to be particularly specified, but may be 300° C. or lower or 200° C. or lower.

In the third embodiment, similarly to the first embodiment or the second embodiment, after the first thermomechanical treatment (band segregation reduction treatment) is performed, the above second thermomechanical treatment (hot rolling and a controlled cooling treatment) is performed. Furthermore, similarly to the first embodiment, the third thermomechanical treatment (low-temperature two-phase region treatment) is performed. Therefore, the first thermomechanical treatment (band segregation reduction treatment) and the third thermomechanical treatment (low-temperature two-phase region treatment) will not be described.

Thus far, the third embodiment has been described.

Steel plates manufactured by the first embodiment, the second embodiment, and the third embodiment are excellent in fracture-resisting performance at approximately −160° C., and can be used for general welded structures such as ships, bridges, constructions, offshore structures, pressure vessels, tanks, and line pipes. Particularly, the steel plate manufactured by the manufacturing method is effective for use in an LNG tank which demands fracture-resisting performance at an extremely low temperature of approximately −160° C.

Figure 4:
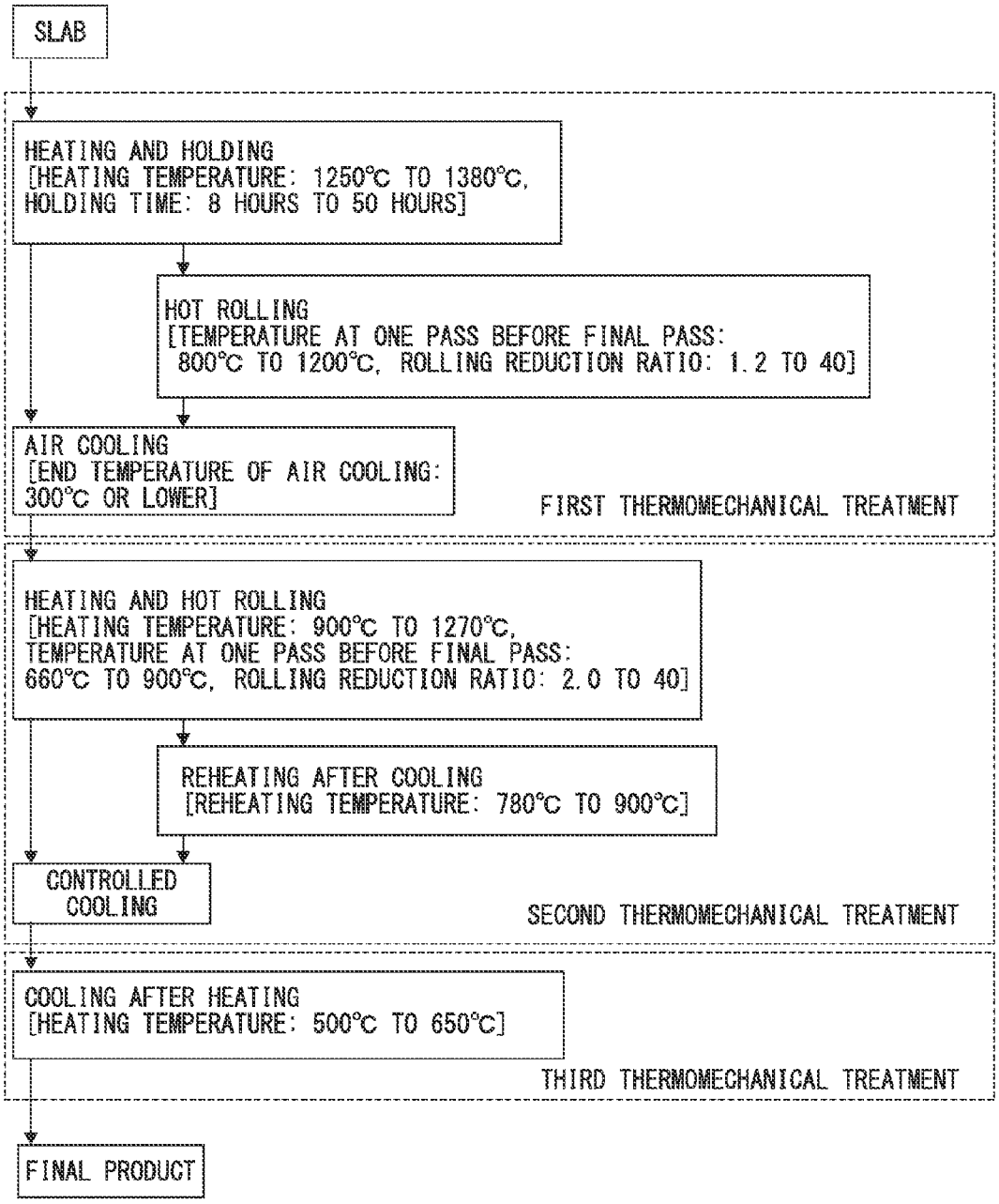
FIG. 4 is a flow chart illustrating a method of manufacturing a Ni-added steel plate according to respective embodiments of the invention.

Meanwhile, the Ni-added steel plate of the invention can be preferably manufactured using the above embodiments as schematically shown in FIG. 4, but the embodiments simply show an example of the manufacturing method of a Ni-added steel plate of the invention. For example, the manufacturing method of a Ni-added steel plate of the invention is not particularly limited as long as the Ni segregation ratio, the fraction of austenite after deep cooling, the average equivalent circle diameter, and the austenite unevenness index after deep cooling can be controlled to be in the above appropriate ranges.

EXAMPLES

The following evaluations were carried out on steel plates having a plate thickness of 6 mm to 50 mm which were manufactured using various chemical components under manufacturing conditions. The yield stress and tensile strength of a base metal were evaluated by tensile tests, and the CTOD values of a base metal and a welded joint were obtained by CTOD test, thereby the toughness of the base metal and the welded joint were evaluated. In addition, the cracking entry distance in the base metal and the welded joint were obtained by duplex ESSO test, thereby the arrestability of the base metal and the welded joint were evaluated. Furthermore, by confirming whether or not unstable ductile fracture was generated from the brittle cracking that was stopped by the duplex ESSO test of the welded joint, unstable fracture-suppressing characteristic of the welded joint was evaluated. The chemical components of the steel plates are shown in Tables 1 and 2. In addition, the plate thickness of the steel plates, the Ni segregation ratios, the contents of austenite after deep cooling, the austenite unevenness indexes after deep cooling and the average equivalent circle diameters are shown in Tables 3 and 4. Furthermore, the manufacturing methods of the steel plates are shown in Tables 5 and 6, and the evaluation results of the fracture-resisting performance of the base metal and the welded joint are shown in Tables 7 and 8. Meanwhile, in the first thermomechanical treatment, the slab was cooled by air cooling to 300° C. or lower before the second thermomechanical treatment. In the second thermomechanical treatment, steel was cooled to 200° C. or lower before all reheating including reheating for the third thermomechanical treatment.

| | C | Si | Mn | P | S | Ni | Al | N | T · O | OTHERS |
|---|---|---|---|---|---|---|---|---|---|---|
| | | | | | | Mass % | | | | |
| EXAMPLE 1 | 0.06 | 0.10 | 0.92 | 0.0040 | 0.0031 | 7.8 | 0.051 | 0.0019 | 0.0015 | |
| COMPARATIVE EXAMPLE 1 | 0.11 | 0.10 | 0.94 | 0.0041 | 0.0033 | 7.9 | 0.054 | 0.0020 | 0.0013 | |
| EXAMPLE 2 | 0.09 | 0.06 | 0.76 | 0.0048 | 0.0011 | 9.8 | 0.040 | 0.0024 | 0.0014 | 0.4 Cu |
| COMPARATIVE EXAMPLE 2 | 0.09 | 0.13 | 0.81 | 0.0047 | 0.0011 | 9.9 | 0.040 | 0.0025 | 0.0014 | 0.4 Cu |
| EXAMPLE 3 | 0.08 | 0.04 | 0.69 | 0.0061 | 0.0004 | 9.8 | 0.046 | 0.0011 | 0.0004 | |
| COMPARATIVE EXAMPLE 3 | 0.09 | 0.04 | 1.02 | 0.0059 | 0.0004 | 9.5 | 0.049 | 0.0010 | 0.0004 | |

-continued

| | C | Si | Mn | P | S | Ni | Al | N | T · O | OTHERS |
|---|---|---|---|---|---|---|---|---|---|---|
| | | | | | | Mass % | | | | |
| EXAMPLE 4 | 0.07 | 0.10 | 0.61 | 0.0017 | 0.0019 | 8.3 | 0.027 | 0.0018 | 0.0022 | 0.012 Ti |
| COMPARATIVE EXAMPLE 4 | 0.07 | 0.10 | 0.66 | 0.0110 | 0.0019 | 8.6 | 0.025 | 0.0019 | 0.0020 | 0.012 Ti |
| EXAMPLE 5 | 0.10 | 0.12 | 0.94 | 0.0016 | 0.0028 | 8.5 | 0.064 | 0.0020 | 0.0025 | |
| COMPARATIVE EXAMPLE 5 | 0.09 | 0.12 | 0.97 | 0.0016 | 0.0037 | 8.8 | 0.063 | 0.0021 | 0.0023 | |
| EXAMPLE 6 | 0.08 | 0.02 | 0.70 | 0.0041 | 0.0033 | 8.1 | 0.045 | 0.0022 | 0.0003 | 0.008 Nb |
| COMPARATIVE EXAMPLE 6 | 0.07 | 0.02 | 0.66 | 0.0041 | 0.0030 | 7.1 | 0.046 | 0.0022 | 0.0003 | 0.008 Nb |
| EXAMPLE 7 | 0.10 | 0.04 | 0.48 | 0.0090 | 0.0009 | 8.3 | 0.022 | 0.0007 | 0.0015 | |
| COMPARATIVE EXAMPLE 7 | 0.09 | 0.05 | 0.51 | 0.0090 | 0.0009 | 8.3 | 0.082 | 0.0006 | 0.0014 | |
| EXAMPLE 8 | 0.06 | 0.08 | 0.81 | 0.0093 | 0.0018 | 7.6 | 0.052 | 0.0052 | 0.0019 | 0.015 V, 0.002 REM |
| COMPARATIVE EXAMPLE 8 | 0.06 | 0.08 | 0.81 | 0.0093 | 0.0017 | 7.7 | 0.057 | 0.0071 | 0.0017 | 0.015 V, 0.002 REM |
| EXAMPLE 9 | 0.04 | 0.05 | 0.82 | 0.0031 | 0.0002 | 9.9 | 0.059 | 0.0009 | 0.0021 | |
| COMPARATIVE EXAMPLE 9 | 0.04 | 0.06 | 0.82 | 0.0031 | 0.0001 | 10.0 | 0.065 | 0.0009 | 0.0032 | |
| EXAMPLE 10 | 0.04 | 0.05 | 0.73 | 0.0085 | 0.0012 | 8.7 | 0.042 | 0.0015 | 0.0008 | 0.3 Cr |
| COMPARATIVE EXAMPLE 10 | 0.04 | 0.05 | 0.78 | 0.0084 | 0.0012 | 8.6 | 0.046 | 0.0014 | 0.0008 | 0.3 Cr |
| EXAMPLE 11 | 0.05 | 0.11 | 0.81 | 0.0074 | 0.0011 | 8.7 | 0.061 | 0.0048 | 0.0029 | |
| COMPARATIVE EXAMPLE 11 | 0.05 | 0.11 | 0.82 | 0.0079 | 0.0011 | 8.7 | 0.062 | 0.0048 | 0.0028 | |
| EXAMPLE 12 | 0.09 | 0.07 | 0.74 | 0.0031 | 0.0010 | 9.3 | 0.021 | 0.0008 | 0.0013 | 0.2 Mo |
| COMPARATIVE EXAMPLE 12 | 0.13 | 0.08 | 0.70 | 0.0031 | 0.0010 | 9.4 | 0.021 | 0.0009 | 0.0013 | 0.2 Mo |
| EXAMPLE 13 | 0.04 | 0.04 | 0.50 | 0.0024 | 0.0009 | 9.1 | 0.058 | 0.0040 | 0.0023 | |
| COMPARATIVE EXAMPLE 13 | 0.04 | 0.04 | 1.13 | 0.0022 | 0.0009 | 9.1 | 0.063 | 0.0040 | 0.0022 | |
| EXAMPLE 14 | 0.09 | 0.06 | 0.93 | 0.0070 | 0.0001 | 9.2 | 0.054 | 0.0014 | 0.0003 | |
| COMPARATIVE EXAMPLE 14 | 0.12 | 0.06 | 0.96 | 0.0070 | 0.0001 | 9.1 | 0.055 | 0.0013 | 0.0002 | |

TABLE 2

| | C | Si | Mn | P | S | Ni | Al | N | T · O | OTHERS |
|---|---|---|---|---|---|---|---|---|---|---|
| | | | | | | Mass % | | | | |
| EXAMPLE 15 | 0.05 | 0.08 | 0.87 | 0.0093 | 0.0018 | 9.0 | 0.042 | 0.0047 | 0.0026 | |
| COMPARATIVE EXAMPLE 15 | 0.05 | 0.08 | 0.90 | 0.0092 | 0.0019 | 8.8 | 0.039 | 0.0047 | 0.0025 | |
| EXAMPLE 16 | 0.04 | 0.12 | 0.66 | 0.0038 | 0.0007 | 7.5 | 0.042 | 0.0051 | 0.0006 | |
| COMPARATIVE EXAMPLE 16 | 0.04 | 0.12 | 0.68 | 0.0037 | 0.0007 | 7.8 | 0.043 | 0.0052 | 0.0068 | |
| EXAMPLE 17 | 0.06 | 0.07 | 0.86 | 0.0097 | 0.0030 | 7.8 | 0.037 | 0.0057 | 0.0019 | |
| COMPARATIVE EXAMPLE 17 | 0.06 | 0.07 | 0.80 | 0.0125 | 0.0030 | 7.9 | 0.041 | 0.0053 | 0.0019 | |
| EXAMPLE 18 | 0.09 | 0.04 | 0.94 | 0.0028 | 0.0031 | 9.2 | 0.023 | 0.0049 | 0.0009 | |
| COMPARATIVE EXAMPLE 18 | 0.09 | 0.04 | 0.91 | 0.0028 | 0.0028 | 9.5 | 0.022 | 0.0045 | 0.0008 | |
| EXAMPLE 19 | 0.04 | 0.09 | 0.44 | 0.0019 | 0.0018 | 9.0 | 0.017 | 0.0065 | 0.0024 | 0.001 B |
| COMPARATIVE EXAMPLE 19 | 0.04 | 0.09 | 0.44 | 0.0019 | 0.0018 | 6.7 | 0.019 | 0.0065 | 0.0024 | 0.001 B |
| EXAMPLE 20 | 0.08 | 0.06 | 0.92 | 0.0049 | 0.0020 | 7.7 | 0.039 | 0.0012 | 0.0021 | |
| COMPARATIVE EXAMPLE 20 | 0.08 | 0.07 | 0.90 | 0.0050 | 0.0120 | 7.8 | 0.037 | 0.0013 | 0.0020 | 0.0023 Ca |
| EXAMPLE 21 | 0.09 | 0.03 | 0.81 | 0.0023 | 0.0002 | 8.7 | 0.039 | 0.0057 | 0.0011 | 0.0021 Ca |
| COMPARATIVE EXAMPLE 21 | 0.09 | 0.03 | 0.79 | 0.0023 | 0.0002 | 8.8 | 0.038 | 0.0061 | 0.0010 | |
| EXAMPLE 22 | 0.06 | 0.07 | 0.35 | 0.0037 | 0.0024 | 7.9 | 0.032 | 0.0021 | 0.0029 | |
| COMPARATIVE EXAMPLE 22 | 0.06 | 0.07 | 0.36 | 0.0037 | 0.0024 | 7.2 | 0.031 | 0.0022 | 0.0029 | 0.015 Nb |
| EXAMPLE 23 | 0.06 | 0.08 | 0.83 | 0.0037 | 0.0030 | 9.3 | 0.058 | 0.0006 | 0.0028 | 0.015 Nb |
| COMPARATIVE EXAMPLE 23 | 0.06 | 0.08 | 0.84 | 0.0037 | 0.0029 | 9.1 | 0.060 | 0.0006 | 0.0025 | |
| EXAMPLE 24 | 0.07 | 0.07 | 0.89 | 0.0046 | 0.0024 | 9.2 | 0.045 | 0.0029 | 0.0003 | 0.2 Mo |
| COMPARATIVE EXAMPLE 24 | 0.07 | 0.07 | 0.95 | 0.0050 | 0.0023 | 9.3 | 0.045 | 0.0031 | 0.0003 | 0.2 Mo |
| EXAMPLE 25 | 0.06 | 0.11 | 0.62 | 0.0022 | 0.0008 | 8.6 | 0.041 | 0.0039 | 0.0012 | |
| COMPARATIVE EXAMPLE 25 | 0.06 | 0.11 | 0.61 | 0.0023 | 0.0007 | 8.6 | 0.041 | 0.0038 | 0.0012 | |
| EXAMPLE 26 | 0.05 | 0.08 | 0.70 | 0.0011 | 0.0007 | 8.8 | 0.039 | 0.0038 | 0.0014 | |
| COMPARATIVE EXAMPLE 26 | 0.05 | 0.09 | 0.71 | 0.0012 | 0.0008 | 8.7 | 0.039 | 0.0040 | 0.0013 | |
| EXAMPLE 27 | 0.06 | 0.09 | 0.60 | 0.0016 | 0.0018 | 8.4 | 0.026 | 0.0019 | 0.0023 | |
| COMPARATIVE EXAMPLE 27 | 0.06 | 0.09 | 0.61 | 0.0111 | 0.0018 | 8.5 | 0.026 | 0.0019 | 0.0020 | |
| EXAMPLE 28 | 0.07 | 0.03 | 0.71 | 0.0040 | 0.0032 | 8.1 | 0.041 | 0.0021 | 0.0004 | |
| COMPARATIVE EXAMPLE 28 | 0.07 | 0.03 | 0.67 | 0.0042 | 0.0031 | 7.1 | 0.045 | 0.0021 | 0.0003 | |

| | CAST SLAB THICKNESS mm | INTERMEDIATE SLAB THICKNESS mm | PLATE THICKNESS mm | Ni SEGRE-GATION RATIO — | FRAC-TION OF γ AFTER DEEP COOLING % | AVERAGE EQUIVALENT CIRCLE DIAMETER OF γ AFTER DEEP COOLING μm | γ UN-EVENNESS INDEX AFTER DEEP COOLING — |
|---|---|---|---|---|---|---|---|
| EXAMPLE 1 | 240 | 30 | 6 | 1.10 | 0.7 | 0.8 | 1.6 |
| COMPARATIVE EXAMPLE 1 | 240 | 30 | 6 | 1.12 | 0.8 | 0.9 | 1.8 |
| EXAMPLE 2 | 300 | 63 | 12 | 1.12 | 3.3 | 0.7 | 1.5 |
| COMPARATIVE EXAMPLE 2 | 300 | 63 | 12 | 1.10 | 0.4 | 0.6 | 1.7 |
| EXAMPLE 3 | 400 | 250 | 20 | 1.19 | 3.8 | 0.7 | 2.5 |
| COMPARATIVE EXAMPLE 3 | 400 | 380 | 20 | 1.17 | 3.8 | 0.7 | 2.9 |
| EXAMPLE 4 | 500 | 120 | 32 | 1.13 | 6.4 | 0.9 | 2.5 |
| COMPARATIVE EXAMPLE 4 | 500 | 120 | 32 | 1.16 | 5.6 | 0.9 | 2.3 |
| EXAMPLE 5 | 700 | 300 | 40 | 1.28 | 3.0 | 0.7 | 2.7 |
| COMPARATIVE EXAMPLE 5 | 700 | 300 | 40 | 1.24 | 4.5 | 1.2 | 2.6 |
| EXAMPLE 6 | 240 | 111 | 40 | 1.21 | 0.9 | 0.5 | 2.5 |
| COMPARATIVE EXAMPLE 6 | 240 | 125 | 40 | 1.21 | 1.5 | 0.5 | 2.5 |
| EXAMPLE 7 | 300 | 34 | 6 | 1.08 | 4.7 | 0.7 | 1.3 |
| COMPARATIVE EXAMPLE 7 | 300 | 34 | 6 | 1.08 | 3.6 | 0.7 | 1.4 |
| EXAMPLE 8 | 400 | 71 | 12 | 1.03 | 5.8 | 0.6 | 1.2 |
| COMPARATIVE EXAMPLE 8 | 400 | 63 | 12 | 1.06 | 5.4 | 0.6 | 1.2 |
| EXAMPLE 9 | 500 | 143 | 20 | 1.21 | 4.3 | 0.7 | 1.6 |
| COMPARATIVE EXAMPLE 9 | 500 | 125 | 20 | 1.22 | 4.5 | 0.8 | 1.8 |
| EXAMPLE 10 | 700 | 500 | 32 | 1.14 | 0.6 | 0.4 | 1.5 |
| COMPARATIVE EXAMPLE 10 | 700 | 500 | 32 | 1.35 | 0.6 | 0.4 | 3.3 |
| EXAMPLE 11 | 240 | 161 | 40 | 1.08 | 2.3 | 0.6 | 2.8 |
| COMPARATIVE EXAMPLE 11 | 200 | 125 | 40 | 1.33 | 2.2 | 0.7 | 3.2 |
| EXAMPLE 12 | 300 | 200 | 50 | 1.27 | 6.8 | 0.9 | 2.5 |
| COMPARATIVE EXAMPLE 12 | 300 | 100 | 50 | 1.33 | 4.3 | 0.9 | 3.8 |
| EXAMPLE 13 | 400 | 200 | 6 | 1.06 | 2.3 | 0.8 | 2.3 |
| COMPARATIVE EXAMPLE 13 | 400 | 280 | 6 | 1.36 | 5.1 | 0.7 | 4.3 |
| EXAMPLE 14 | 500 | 200 | 12 | 1.29 | 5.6 | 0.9 | 2.7 |
| COMPARATIVE EXAMPLE 14 | 500 | 200 | 12 | 1.28 | 0.3 | 1.2 | 2.8 |

| | CAST SLAB THICKNESS mm | INTER-MEDIATE SLAB THICKNESS mm | PLATE THICKNESS mm | Ni SEGREGATION RATIO — | FRACTION OF γ AFTER DEEP COOLING % | AVERAGE EQUIVALENT CIRCLE DIAMETER OF γ AFTER DEEP COOLING μm | γ UNEVENNESS INDEX AFTER DEEP COOLING — |
|---|---|---|---|---|---|---|---|
| EXAMPLE 15 | 700 | 200 | 20 | 1.22 | 1.5 | 0.9 | 2.2 |
| COMPARATIVE EXAMPLE 15 | 700 | 90 | 20 | 1.21 | 0.3 | 1.3 | 2.3 |
| EXAMPLE 16 | 240 | 200 | 32 | 1.31 | 7.5 | 0.6 | 1.8 |
| COMPARATIVE EXAMPLE 16 | 240 | 200 | 32 | 1.15 | 4.9 | 0.5 | 1.7 |
| EXAMPLE 17 | 300 | 200 | 40 | 1.06 | 0.8 | 0.9 | 1.6 |
| COMPARATIVE EXAMPLE 17 | 300 | 95 | 40 | 1.10 | 0.7 | 1.2 | 1.7 |
| EXAMPLE 18 | 400 | 100 | 50 | 1.13 | 2.8 | 0.7 | 2.6 |
| COMPARATIVE EXAMPLE 18 | 400 | 100 | 50 | 1.08 | 0.3 | 1.5 | 2.5 |
| EXAMPLE 19 | 500 | 63 | 6 | 1.05 | 2.7 | 0.7 | 1.8 |
| COMPARATIVE EXAMPLE 19 | 500 | 63 | 6 | 1.06 | 5.9 | 0.8 | 1.8 |
| EXAMPLE 20 | 700 | 80 | 12 | 1.14 | 4.5 | 0.8 | 2.2 |
| COMPARATIVE EXAMPLE 20 | 700 | 80 | 12 | 1.15 | 3.7 | 0.8 | 2.3 |
| EXAMPLE 21 | 240 | 125 | 20 | 1.18 | 1.5 | 0.8 | 2.3 |
| COMPARATIVE EXAMPLE 21 | 240 | 125 | 20 | 1.17 | 0.3 | 0.8 | 2.7 |
| EXAMPLE 22 | 300 | 63 | 32 | 1.11 | 5.0 | 0.8 | 1.8 |
| COMPARATIVE EXAMPLE 22 | 300 | 45 | 32 | 1.10 | 9.4 | 1.6 | 1.7 |
| EXAMPLE 23 | 400 | 200 | 40 | 1.12 | 1.1 | 0.6 | 2.5 |
| COMPARATIVE EXAMPLE 23 | 400 | 63 | 40 | 1.14 | 0.4 | 1.4 | 2.6 |
| EXAMPLE 24 | 500 | 200 | 50 | 1.03 | 1.5 | 0.6 | 1.5 |
| COMPARATIVE EXAMPLE 24 | 500 | 150 | 50 | 1.06 | 0.3 | 0.7 | 1.7 |
| EXAMPLE 25 | 320 | 160 | 32 | 1.03 | 5.4 | 0.9 | 1.8 |
| COMPARATIVE EXAMPLE 25 | 320 | 160 | 32 | 1.44 | 3.4 | 0.9 | 3.5 |
| EXAMPLE 26 | 120 | 120 | 12 | 1.03 | 4.6 | 0.1 | 1.3 |
| COMPARATIVE EXAMPLE 26 | 120 | 120 | 12 | 1.38 | 5.5 | 0.1 | 1.4 |
| EXAMPLE 27 | 120 | 120 | 32 | 1.14 | 6.5 | 0.8 | 2.4 |
| COMPARATIVE EXAMPLE 27 | 120 | 120 | 32 | 1.15 | 5.5 | 0.9 | 2.4 |
| EXAMPLE 28 | 111 | 111 | 40 | 1.20 | 0.9 | 0.4 | 2.6 |
| COMPARATIVE EXAMPLE 28 | 125 | 125 | 40 | 1.22 | 1.6 | 0.5 | 2.5 |

| | FIRST THERMOMECHANICAL TREATMENT (BAND SEGREGATION REDUCTION TREATMENT) | | | | SECOND THERMOMECHANICAL TREATMENT (HOT ROLLING AND CONTROLLED COOLING TREATMENT) | |
|---|---|---|---|---|---|---|
| | HEATING TEMPERATURE ° C. | HOLDING TIME hr | ROLLING REDUCTION — | TEMPERATURE AT ONE PASS BEFORE FINAL PASS ° C. | HEATING TEMPERATURE ° C. | ROLLING REDUCTION — |
| EXAMPLE 1 | 1283 | 29 | 8.0 | 1048 | 1224 | 5.0 |
| COMPARATIVE EXAMPLE 1 | 1313 | 29 | 8.0 | 1063 | 1245 | 5.0 |
| EXAMPLE 2 | 1289 | 22 | 4.8 | 818 | 1260 | 5.2 |
| COMPARATIVE EXAMPLE 2 | 1314 | 22 | 4.8 | 827 | 1290 | 5.2 |
| EXAMPLE 3 | 1361 | 16 | 1.6 | 1121 | 1064 | 12.5 |
| COMPARATIVE EXAMPLE 3 | 1373 | 9 | 1.1 | 1127 | 1059 | 19.0 |
| EXAMPLE 4 | 1346 | 11 | 4.2 | 1047 | 969 | 3.8 |
| COMPARATIVE EXAMPLE 4 | 1376 | 12 | 4.2 | 1068 | 987 | 3.8 |
| EXAMPLE 5 | 1327 | 9 | 2.3 | 1172 | 1087 | 7.5 |
| COMPARATIVE EXAMPLE 5 | 1319 | 9 | 2.3 | 1156 | 1110 | 7.5 |
| EXAMPLE 6 | 1315 | 12 | 2.2 | 932 | 1054 | 2.8 |
| COMPARATIVE EXAMPLE 6 | 1321 | 11 | 1.9 | 942 | 1037 | 3.1 |
| EXAMPLE 7 | 1250 | 45 | 8.8 | 838 | 1263 | 5.7 |
| COMPARATIVE EXAMPLE 7 | 1284 | 45 | 8.8 | 860 | 1268 | 5.7 |

-continued

| | | | | | | |
|---|---|---|---|---|---|---|
| EXAMPLE 8 | 1282 | 40 | 5.6 | 998 | 1109 | 6.0 |
| COMPARATIVE EXAMPLE 8 | 1313 | 40 | 6.4 | 985 | 1116 | 5.2 |
| EXAMPLE 9 | 1282 | 12 | 3.5 | 947 | 1028 | 7.1 |
| COMPARATIVE EXAMPLE 9 | 1300 | 13 | 4.0 | 941 | 1053 | 6.3 |
| EXAMPLE 10 | 1326 | 29 | 1.4 | 1198 | 933 | 15.6 |
| COMPARATIVE EXAMPLE 10 | 1245 | 30 | 1.4 | 1214 | 959 | 15.6 |
| EXAMPLE 11 | 1324 | 46 | 1.5 | 834 | 1022 | 4.0 |
| COMPARATIVE EXAMPLE 11 | 1349 | 7 | 1.6 | 859 | 1063 | 3.1 |
| EXAMPLE 12 | 1297 | 10 | 1.5 | 990 | 1120 | 4.0 |
| COMPARATIVE EXAMPLE 12 | 1293 | 10 | 3.0 | 790 | 1129 | 2.0 |
| EXAMPLE 13 | 1351 | 23 | 2.0 | 1028 | 1193 | 33.3 |
| COMPARATIVE EXAMPLE 13 | 1355 | 23 | 1.4 | 1234 | 1221 | 46.7 |
| EXAMPLE 14 | 1274 | 19 | 2.5 | 849 | 1216 | 16.7 |
| COMPARATIVE EXAMPLE 14 | 1285 | 19 | 2.5 | 851 | 883 | 16.7 |

| | SECOND THERMOMECHANICAL TREATMENT (HOT ROLLING AND CONTROLLED COOLING TREATMENT) | | | THIRD THERMOMECHANICAL TREATMENT (LOW-TEMPERATURE TWO-PHASE REGION TREATMENT) | |
|---|---|---|---|---|---|
| | TEMPERATURE AT ONE PASS BEFORE FINAL PASS ° C. | END TEMPERATURE OF WATER COOLING*1 ° C. | REHEATING TEMPERATURE ° C. | HEATING TEMPERATURE ° C. | END TEMPERATURE OF WATER COOLING*1 |
| EXAMPLE 1 | 774 | — | 800 | 612 | — |
| COMPARATIVE EXAMPLE 1 | 782 | — | 800 | 615 | — |
| EXAMPLE 2 | 758 | 102 | — | 571 | 20 |
| COMPARATIVE EXAMPLE 2 | 769 | 103 | — | 581 | 20 |
| EXAMPLE 3 | 700 | 189 | — | 648 | — |
| COMPARATIVE EXAMPLE 3 | 706 | 187 | — | 657 | — |
| EXAMPLE 4 | 696 | 165 | — | 600 | 50 |
| COMPARATIVE EXAMPLE 4 | 704 | 167 | — | 610 | 50 |
| EXAMPLE 5 | 895 | 143 | — | 522 | — |
| COMPARATIVE EXAMPLE 5 | 904 | 145 | — | 535 | — |
| EXAMPLE 6 | 807 | 126 | — | 580 | 40 |
| COMPARATIVE EXAMPLE 6 | 818 | 128 | — | 584 | 40 |
| EXAMPLE 7 | 673 | 84 | — | 531 | — |
| COMPARATIVE EXAMPLE 7 | 678 | 85 | — | 529 | — |
| EXAMPLE 8 | 662 | — | 810 | 647 | — |
| COMPARATIVE EXAMPLE 8 | 675 | — | 770 | 660 | — |
| EXAMPLE 9 | 740 | 115 | — | 632 | 150 |
| COMPARATIVE EXAMPLE 9 | 745 | 118 | — | 643 | 150 |
| EXAMPLE 10 | 699 | 160 | — | 621 | — |
| COMPARATIVE EXAMPLE 10 | 703 | 160 | — | 620 | — |
| EXAMPLE 11 | 743 | 149 | — | 625 | — |
| COMPARATIVE EXAMPLE 11 | 752 | 150 | — | 625 | — |
| EXAMPLE 12 | 867 | 166 | — | 551 | — |
| COMPARATIVE EXAMPLE 12 | 879 | 167 | — | 557 | — |
| EXAMPLE 13 | 680 | — | 850 | 565 | — |
| COMPARATIVE EXAMPLE 13 | 689 | — | 850 | 565 | — |
| EXAMPLE 14 | 859 | 24 | — | 599 | 170 |
| COMPARATIVE EXAMPLE 14 | 665 | 24 | — | 609 | 170 |

*1"—" INDICATES THAT AIR COOLING WAS PERFORMED AS THE CONTROLLED COOLING

TABLE 6

| | FIRST THERMOMECHANICAL TREATMENT (BAND SEGREGATION REDUCTION TREATMENT) | | | | SECOND THERMOMECHANICAL TREATMENT (HOT ROLLING AND CONTROLLED COOLING TREATMENT) | |
|---|---|---|---|---|---|---|
| | HEATING TEMPERATURE ° C. | HOLDING TIME hr | ROLLING REDUCTION — | TEMPERATURE ONE PASS BEFORE FINAL PASS ° C. | HEATING TEMPERATURE ° C. | ROLLING REDUCTION — |
| EXAMPLE 15 | 1272 | 10 | 3.5 | 914 | 1069 | 10.0 |
| COMPARATIVE EXAMPLE 15 | 1317 | 10 | 7.8 | 926 | 1307 | 4.5 |
| EXAMPLE 16 | 1311 | 13 | 1.2 | 1102 | 1242 | 6.3 |
| COMPARATIVE EXAMPLE 16 | 1328 | 13 | 1.2 | 1104 | 1268 | 6.3 |
| EXAMPLE 17 | 1362 | 38 | 1.5 | 969 | 1267 | 5.0 |
| COMPARATIVE EXAMPLE 17 | 1335 | 39 | 3.2 | 982 | 1269 | 2.4 |
| EXAMPLE 18 | 1324 | 44 | 4.0 | 1075 | 1111 | 2.0 |
| COMPARATIVE EXAMPLE 18 | 1305 | 44 | 4.0 | 1072 | 1142 | 1.8 |
| EXAMPLE 19 | 1303 | 38 | 8.0 | 1147 | 1211 | 10.4 |
| COMPARATIVE EXAMPLE 19 | 1302 | 38 | 8.0 | 1157 | 1246 | 10.4 |
| EXAMPLE 20 | 1266 | 24 | 8.8 | 1007 | 1265 | 6.7 |

TABLE 6-continued

| | | | | | | |
|---|---|---|---|---|---|---|
| COMPARATIVE EXAMPLE 20 | 1274 | 24 | 8.8 | 1013 | 1255 | 6.7 |
| EXAMPLE 21 | 1364 | 30 | 1.9 | 1048 | 1140 | 6.3 |
| COMPARATIVE EXAMPLE 21 | 1351 | 30 | 1.9 | 1039 | 1159 | 6.3 |
| EXAMPLE 22 | 1269 | 34 | 4.8 | 1167 | 920 | 2.0 |
| COMPARATIVE EXAMPLE 22 | 1287 | 34 | 6.7 | 1185 | 943 | 1.4 |
| EXAMPLE 23 | 1332 | 19 | 2.0 | 1041 | 1119 | 5.0 |
| COMPARATIVE EXAMPLE 23 | 1342 | 19 | 6.4 | 1034 | 1162 | 1.6 |
| EXAMPLE 24 | 1296 | 36 | 2.5 | 1100 | 1188 | 4.0 |
| COMPARATIVE EXAMPLE 24 | 1280 | 37 | 3.3 | 1107 | 1196 | 3.0 |
| EXAMPLE 25 | 1338 | 33 | 2.0 | 1165 | 1011 | 5.0 |
| COMPARATIVE EXAMPLE 25 | 1246 | 33 | 2.0 | 1155 | 1032 | 5.0 |
| EXAMPLE 26 | 1338 | 31 | — | — | 1036 | 10.0 |
| COMPARATIVE EXAMPLE 26 | 1336 | 7 | — | — | 1059 | 10.0 |
| EXAMPLE 27 | 1340 | 12 | — | — | 968 | 3.8 |
| COMPARATIVE EXAMPLE 27 | 1370 | 13 | — | — | 988 | 3.8 |
| EXAMPLE 28 | 1320 | 13 | — | — | 1054 | 2.8 |
| COMPARATIVE EXAMPLE 28 | 1321 | 11 | — | — | 1036 | 3.1 |

| | SECOND THERMOMECHANICAL TREATMENT (HOT ROLLING AND CONTROLLED COOLING TREATMENT) | | | THIRD THERMOMECHANICAL TREATMENT (LOW-TEMPERATURE TWO-PHASE REGION TREATMENT) | |
|---|---|---|---|---|---|
| | TEMPERATURE AT ONE PASS BEFORE FINAL PASS ° C. | END TEMPERATURE OF WATER COOLING*1 ° C. | REHEATING TEMPERATURE ° C. | HEATING TEMPERATURE ° C. | END TEMPERATURE OF WATER COOLING*1 ° C. |
| EXAMPLE 15 | 783 | 62 | — | 522 | — |
| COMPARATIVE EXAMPLE 15 | 794 | 63 | — | 520 | — |
| EXAMPLE 16 | 895 | 165 | — | 632 | — |
| COMPARATIVE EXAMPLE 16 | 650 | 168 | — | 643 | — |
| EXAMPLE 17 | 747 | 119 | — | 621 | 20 |
| COMPARATIVE EXAMPLE 17 | 910 | 119 | — | 633 | 20 |
| EXAMPLE 18 | 704 | 19 | — | 647 | — |
| COMPARATIVE EXAMPLE 18 | 715 | 19 | — | 668 | — |
| EXAMPLE 19 | 768 | 73 | — | 645 | — |
| COMPARATIVE EXAMPLE 19 | 780 | 74 | — | 497 | — |
| EXAMPLE 20 | 709 | 69 | — | 618 | 20 |
| COMPARATIVE EXAMPLE 20 | 716 | 69 | — | 477 | 20 |
| EXAMPLE 21 | 843 | — | 790 | 630 | — |
| COMPARATIVE EXAMPLE 21 | 859 | — | 910 | 659 | — |
| EXAMPLE 22 | 840 | 58 | — | 641 | — |
| COMPARATIVE EXAMPLE 22 | 842 | 59 | — | 648 | — |
| EXAMPLE 23 | 779 | 6 | — | 555 | 30 |
| COMPARATIVE EXAMPLE 23 | 785 | 6 | — | 681 | 30 |
| EXAMPLE 24 | 814 | 191 | — | 618 | — |
| COMPARATIVE EXAMPLE 24 | 821 | 190 | — | 672 | — |
| EXAMPLE 25 | 830 | 32 | — | 620 | — |
| COMPARATIVE EXAMPLE 25 | 820 | 35 | — | 624 | — |
| EXAMPLE 26 | 760 | 157 | — | 633 | 5 |
| COMPARATIVE EXAMPLE 26 | 770 | 159 | — | 634 | 5 |
| EXAMPLE 27 | 690 | 165 | — | 600 | — |
| COMPARATIVE EXAMPLE 27 | 703 | 166 | — | 610 | — |
| EXAMPLE 28 | 808 | 125 | — | 580 | — |
| COMPARATIVE EXAMPLE 28 | 817 | 127 | — | 584 | — |

*1"—" INDICATES THAT AIR COOLING WAS PERFORMED AS THE CONTROLLED COOLING

TABLE 7

| | YIELD STRESS MPa | TENSILE STRENGTH MPa | BASE METAL CTOD mm | BASE METAL CTOD EVAL-UATION | BASE METAL DUPLEX ESSO — | BASE METAL DUPLEX ESSO EVAL-UATION | WELDED JOINT CTOD mm | WELDED JOINT CTOD EVAL-UATION | WELDED JOINT DUPLEX ESSO — | WELDED JOINT DUPLEX ESSO EVAL-UATION | UNSTABLE DUCTILE FRACTURE-SUPPRESSING CHARACTERISTIC mm | UNSTABLE DUCTILE FRACTURE-SUPPRESSING CHARACTERISTIC EVAL-UATION |
|---|---|---|---|---|---|---|---|---|---|---|---|---|
| EXAMPLE 1 | 722 | 793 | 0.51 | PASS | 1.7 | PASS | 0.56 | PASS | 1.7 | PASS | NONE | PASS |
| COMPARATIVE EXAMPLE 1 | 752 | 825 | 0.24 | FAIL | 3.0 | FAIL | 0.16 | FAIL | 3.3 | FAIL | NONE | PASS |
| EXAMPLE 2 | 669 | 778 | 0.74 | PASS | 0.0 | PASS | 0.87 | PASS | 0.9 | PASS | NONE | PASS |
| COMPARATIVE | 672 | 782 | 0.28 | FAIL | 2.7 | FAIL | 0.26 | FAIL | 3.8 | FAIL | NONE | PASS |

TABLE 7-continued

| | YIELD STRESS MPa | TENSILE STRENGTH MPa | BASE METAL CTOD mm | BASE METAL CTOD EVALUATION | BASE METAL DUPLEX ESSO — | BASE METAL DUPLEX ESSO EVALUATION | WELDED JOINT CTOD mm | WELDED JOINT CTOD EVALUATION | WELDED JOINT DUPLEX ESSO — | WELDED JOINT DUPLEX ESSO EVALUATION | UNSTABLE DUCTILE FRACTURE-SUPPRESSING CHARACTERISTIC mm | UNSTABLE DUCTILE FRACTURE-SUPPRESSING CHARACTERISTIC EVALUATION |
|---|---|---|---|---|---|---|---|---|---|---|---|---|
| EXAMPLE 2 | | | | | | | | | | | | |
| EXAMPLE 3 | 639 | 743 | 0.91 | PASS | 0.2 | PASS | 0.51 | PASS | 0.2 | PASS | NONE | PASS |
| COMPARATIVE EXAMPLE 3 | 652 | 758 | 0.22 | FAIL | 3.0 | FAIL | 0.19 | FAIL | 6.3 | FAIL | NONE | PASS |
| EXAMPLE 4 | 627 | 689 | 0.83 | PASS | 1.5 | PASS | 0.62 | PASS | 1.0 | PASS | NONE | PASS |
| COMPARATIVE EXAMPLE 4 | 628 | 691 | 0.24 | FAIL | 10.0 | FAIL | 0.18 | FAIL | 7.0 | FAIL | NONE | PASS |
| EXAMPLE 5 | 589 | 685 | 0.66 | PASS | 0.8 | PASS | 0.64 | PASS | 0.8 | PASS | NONE | PASS |
| COMPARATIVE EXAMPLE 5 | 594 | 697 | 0.26 | FAIL | 2.3 | FAIL | 0.08 | FAIL | 3.9 | FAIL | NONE | PASS |
| EXAMPLE 6 | 601 | 668 | 0.37 | PASS | 1.8 | PASS | 0.34 | PASS | 1.6 | PASS | NONE | PASS |
| COMPARATIVE EXAMPLE 6 | 595 | 664 | 0.19 | FAIL | 3.6 | FAIL | 0.07 | FAIL | 4.3 | FAIL | 350 | FAIL |
| EXAMPLE 7 | 724 | 790 | 0.57 | PASS | 0.8 | PASS | 0.56 | PASS | 0.5 | PASS | NONE | PASS |
| COMPARATIVE EXAMPLE 7 | 755 | 838 | 0.23 | FAIL | 3.0 | FAIL | 0.19 | FAIL | 10.0 | FAIL | NONE | PASS |
| EXAMPLE 8 | 669 | 770 | 0.89 | PASS | 0.4 | PASS | 1.01 | PASS | 1.9 | PASS | NONE | PASS |
| COMPARATIVE EXAMPLE 8 | 663 | 781 | 0.28 | FAIL | 4.6 | FAIL | 0.17 | FAIL | 4.3 | FAIL | NONE | PASS |
| EXAMPLE 9 | 645 | 743 | 0.59 | PASS | 1.9 | PASS | 0.35 | PASS | 1.1 | PASS | NONE | PASS |
| COMPARATIVE EXAMPLE 9 | 642 | 747 | 0.29 | FAIL | 2.5 | FAIL | 0.24 | FAIL | 2.9 | FAIL | NONE | PASS |
| EXAMPLE 10 | 649 | 711 | 0.83 | PASS | 0.7 | PASS | 0.70 | PASS | 0.3 | PASS | NONE | PASS |
| COMPARATIVE EXAMPLE 10 | 643 | 715 | 0.72 | PASS | 2.3 | FAIL | 0.19 | FAIL | 3.9 | FAIL | 350 | FAIL |
| EXAMPLE 11 | 604 | 673 | 0.72 | PASS | 0.5 | PASS | 0.75 | PASS | 0.9 | PASS | NONE | PASS |
| COMPARATIVE EXAMPLE 11 | 604 | 670 | 0.38 | PASS | 2.2 | FAIL | 0.23 | FAIL | 5.6 | FAIL | NONE | PASS |
| EXAMPLE 12 | 607 | 671 | 0.79 | PASS | 1.1 | PASS | 0.55 | PASS | 1.1 | PASS | NONE | PASS |
| COMPARATIVE EXAMPLE 12 | 655 | 723 | 0.09 | FAIL | 2.5 | FAIL | 0.18 | FAIL | 3.6 | FAIL | 350 | FAIL |
| EXAMPLE 13 | 683 | 786 | 0.53 | PASS | 1.3 | PASS | 0.58 | PASS | 1.8 | PASS | NONE | PASS |
| COMPARATIVE EXAMPLE 13 | 677 | 780 | 0.19 | FAIL | 4.0 | FAIL | 0.23 | FAIL | 38.0 | FAIL | NONE | PASS |
| EXAMPLE 14 | 684 | 783 | 0.65 | PASS | 0.4 | PASS | 0.53 | PASS | 1.0 | PASS | NONE | PASS |
| COMPARATIVE EXAMPLE 14 | 693 | 799 | 0.19 | FAIL | 4.6 | FAIL | 0.08 | FAIL | 11.1 | FAIL | 350 | FAIL |

TABLE 8

| | YIELD STRESS MPa | TENSILE STRENGTH MPa | BASE METAL CTOD mm | BASE METAL CTOD EVALUATION | BASE METAL DUPLEX ESSO — | BASE METAL DUPLEX ESSO EVALUATION | WELDED JOINT CTOD mm | WELDED JOINT CTOD EVALUATION | WELDED JOINT DUPLEX ESSO — | WELDED JOINT DUPLEX ESSO EVALUATION | UNSTABLE DUCTILE FRACTURE-SUPPRESSING CHARACTERISTIC mm | UNSTABLE DUCTILE FRACTURE-SUPPRESSING CHARACTERISTIC EVALUATION |
|---|---|---|---|---|---|---|---|---|---|---|---|---|
| EXAMPLE 15 | 681 | 740 | 0.66 | PASS | 1.3 | PASS | 0.54 | PASS | 0.3 | PASS | NONE | PASS |
| COMPARATIVE EXAMPLE 15 | 680 | 747 | 0.55 | PASS | 1.8 | PASS | 0.43 | PASS | 1.1 | PASS | 350 | FAIL |
| EXAMPLE 16 | 593 | 686 | 0.35 | PASS | 0.8 | PASS | 0.31 | PASS | 1.2 | PASS | NONE | PASS |
| COMPARATIVE EXAMPLE 16 | 597 | 682 | 0.29 | FAIL | 4.1 | FAIL | 0.09 | FAIL | 2.1 | FAIL | NONE | PASS |
| EXAMPLE 17 | 611 | 688 | 0.55 | PASS | 1.4 | PASS | 0.36 | PASS | 1.7 | PASS | NONE | PASS |
| COMPARATIVE EXAMPLE 17 | 617 | 689 | 0.29 | FAIL | 3.2 | FAIL | 0.19 | FAIL | 5.1 | FAIL | 350 | FAIL |
| EXAMPLE 18 | 628 | 696 | 0.65 | PASS | 1.3 | PASS | 0.54 | PASS | 1.7 | PASS | NONE | PASS |
| COMPARATIVE EXAMPLE 18 | 634 | 695 | 0.25 | FAIL | 4.2 | FAIL | 0.31 | PASS | 1.9 | PASS | NONE | PASS |
| EXAMPLE 19 | 719 | 784 | 0.45 | PASS | 0.8 | PASS | 0.31 | PASS | 1.1 | PASS | NONE | PASS |
| COMPARATIVE EXAMPLE 19 | 716 | 788 | 0.29 | FAIL | 3.7 | FAIL | 0.15 | FAIL | 8.3 | FAIL | NONE | PASS |

TABLE 8-continued

| | YIELD STRESS MPa | TENSILE STRENGTH MPa | BASE METAL CTOD mm | EVAL-UATION | BASE METAL DUPLEX ESSO — | EVAL-UATION | WELDED JOINT CTOD mm | EVAL-UATION | WELDED JOINT DUPLEX ESSO — | EVAL-UATION | UNSTABLE DUCTILE FRACTURE-SUPPRESSING CHARACTERISTIC mm | EVAL-UATION |
|---|---|---|---|---|---|---|---|---|---|---|---|---|
| EXAMPLE 20 | 664 | 772 | 0.57 | PASS | 1.6 | PASS | 0.63 | PASS | 1.5 | PASS | NONE | PASS |
| COMPARATIVE EXAMPLE 20 | 677 | 778 | 0.19 | FAIL | 4.1 | FAIL | 0.03 | FAIL | 5.0 | FAIL | NONE | PASS |
| EXAMPLE 21 | 687 | 747 | 0.80 | PASS | 0.6 | PASS | 0.46 | PASS | 0.9 | PASS | NONE | PASS |
| COMPARATIVE EXAMPLE 21 | 679 | 755 | 0.23 | FAIL | 4.7 | FAIL | 0.38 | PASS | 1.1 | PASS | NONE | PASS |
| EXAMPLE 22 | 627 | 689 | 0.80 | PASS | 1.5 | PASS | 0.65 | PASS | 2.0 | PASS | NONE | PASS |
| COMPARATIVE EXAMPLE 22 | 625 | 682 | 0.27 | FAIL | 3.8 | FAIL | 0.08 | FAIL | 7.0 | FAIL | NONE | PASS |
| EXAMPLE 23 | 597 | 678 | 0.81 | PASS | 1.9 | PASS | 0.71 | PASS | 1.0 | PASS | NONE | PASS |
| COMPARATIVE EXAMPLE 23 | 603 | 679 | 0.24 | FAIL | 3.5 | FAIL | 0.44 | PASS | 1.0 | PASS | NONE | PASS |
| EXAMPLE 24 | 600 | 678 | 0.90 | PASS | 0.7 | PASS | 0.54 | PASS | 0.9 | PASS | NONE | PASS |
| COMPARATIVE EXAMPLE 24 | 614 | 677 | 0.24 | FAIL | 4.3 | FAIL | 0.38 | PASS | 1.9 | PASS | NONE | PASS |
| EXAMPLE 25 | 719 | 693 | 0.43 | PASS | 1.4 | PASS | 0.37 | PASS | 1.6 | PASS | NONE | PASS |
| COMPARATIVE EXAMPLE 25 | 712 | 696 | 0.38 | PASS | 3.8 | FAIL | 0.35 | PASS | 3.7 | FAIL | NONE | PASS |
| EXAMPLE 26 | 715 | 695 | 0.89 | PASS | 1.2 | PASS | 0.38 | PASS | 1.8 | PASS | NONE | PASS |
| COMPARATIVE EXAMPLE 26 | 729 | 700 | 0.85 | PASS | 2.7 | FAIL | 0.35 | PASS | 15.3 | FAIL | 350 | FAIL |
| EXAMPLE 27 | 626 | 690 | 0.84 | PASS | 1.3 | PASS | 0.61 | PASS | 1.1 | PASS | NONE | PASS |
| COMPARATIVE EXAMPLE 27 | 630 | 692 | 0.22 | FAIL | 10.0 | FAIL | 0.16 | FAIL | 7.1 | FAIL | NONE | PASS |
| EXAMPLE 28 | 600 | 670 | 0.36 | PASS | 1.7 | PASS | 0.33 | PASS | 1.5 | PASS | NONE | PASS |
| COMPARATIVE EXAMPLE 28 | 596 | 665 | 0.18 | FAIL | 3.5 | FAIL | 0.06 | FAIL | 4.4 | FAIL | 350 | FAIL |

The yield stress and the tensile strength were measured using the method of tensile test for metallic materials described in JIS Z 2241. The test specimen was the test piece for tensile test for metallic materials described in JIS Z 2201. Here, No. 5 test specimens were used for steel plates having a plate thickness of 20 mm or less, and No. 10 test specimens taken from the ¼t area were used for steel plates having a plate thickness of 40 mm or more. Meanwhile, the test specimens were taken such that the longitudinal direction of the test specimen became perpendicular to the rolling direction. The yield stress was the 0.2% endurance calculated by the offset method. The test was carried out on two test specimens at room temperature, and average values were adopted for the yield stress and the tensile strength respectively.

The toughness of the base metal and the welded joint was evaluated by the CTOD test based on BS7448. B×2B-type test specimens were used, and a 3-point bending test was carried out. For the base metal, evaluations were carried out with respect to a C direction (plate thickness direction) such that the longitudinal direction of the test specimen became perpendicular to the rolling direction. For the welded joint, evaluations were carried out with respect to only an L direction (rolling direction). In order to evaluate of the CTOD value of the welded joint, test specimens were taken so that the front end of fatigue cracking corresponded to a welded bond. The test was carried out on 3 test specimens at a test temperature of −165° C., and the minimum value that was obtained by measurement was adopted as the CTOD value. For the CTOD test results (CTOD values), 0.3 mm or more was evaluated to be a "pass," and less than 0.3 mm was evaluated to be a "fail."

Figure 5:
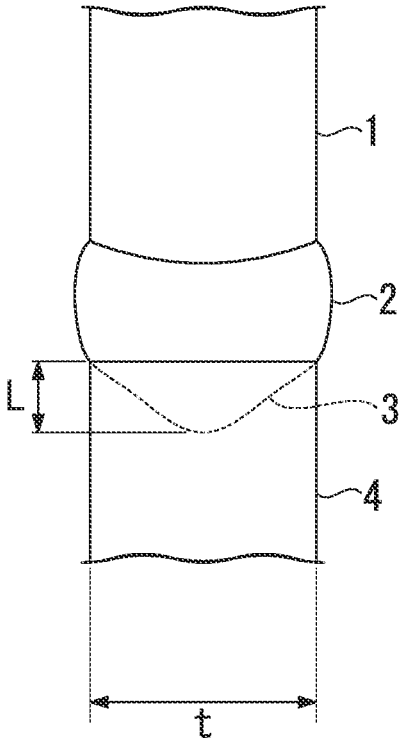
FIG. 5 is a partial schematic view exemplifying a cracked surface of a tested area after a duplex ESSO test.

The arrestability of the base metal and the welded joint was evaluated by the duplex ESSO test. The duplex ESSO test was carried out based on the method described in FIG. 3 in Pressure Technologies, Vol. 29, No. 6, p. 341. Meanwhile, the load stress was set to 392 MPa, and the test temperature was set to −165° C. in the duplex ESSO test, when the cracking entry distance was twice of or less than the plate thickness, the arrestability was evaluated to be a "pass," and when the cracking entry distance was more than twice of the plate thickness, the arrestability was evaluated to be a "fail." FIG. 5 shows a partial schematic view of an example of a cracked surface of a tested area after the duplex ESSO test. The cracked surface referred to an area including all of an embrittlement plate (entrance plate) 1, an attached welded area 2, and a cracking entry area 3 in FIG. 5, and the cracking entry distance L refers to the maximum length of the cracking entry area 3 (cracked area entering into the tested area (a base metal or a welded metal) 4 in a direction perpendicular to the direction of the plate thickness t. Meanwhile, for simple description, FIG. 5 shows only part of the embrittlement plate 1 and the tested area 4.

Here, the duplex ESSO test referred to a testing method schematically shown in, for example, the duplex ESSO test of FIG. 6 in H. Miyakoshi, N. Ishikura, T. Suzuki and K. Tanaka: Proceedings for Transmission Conf, Atlanta, 1981, American Gas Association, T155-T166.

Meanwhile, the welded joint used in the CTOD test and the duplex ESSO test was manufactured using SMAW. The SMAW was vertical welding under conditions that a heat input was 3.5 kJ/cm to 4.0 kJ/cm, and a temperature of preheating and a temperature between passes were 100° C. or lower.

The unstable ductile fracture-suppressing characteristic of the welded joint was evaluated from the above test results of the duplex ESSO test of the welded joint (changes in the fractured surface). That is, when the propagation of the brittle cracking stopped, and then cracking again proceeded due to unstable ductile fracture, the proceeding distance of the cracking due to the unstable ductile fracture (unstable ductile fracture occurrence distance) was recorded.

In Examples 1 to 26, since the chemical components, the Ni segregation ratios, and the conditions (contents, uneven indexes and average equivalent circle diameters) of austenite after deep cooling were appropriate, the fracture-resisting performances of the base metal and the welded joint were all "pass."

In Comparative examples 1 to 9, 12 to 14, 16 and 17, 19 and 20, 22, 27 and 28, since the chemical components were not appropriate, the fracture-resisting performance of the base metal or of the welded joint was "fail."

In Comparative examples 10, 11, 25, and 26, since the Ni segregation ratio was not appropriate, the fracture-resisting performance of the base metal or of the welded joint was "fail." in the comparative examples, the conditions for the first thermomechanical treatment were not appropriate. Particularly, in Comparative examples 10, 11, and 25, the austenite unevenness indexes after deep cooling were not appropriate either In Comparative examples 18, and 21, since the fraction of austenite after deep cooling was not appropriate, the fracture-resisting performance of the base metal or of the welded joint was "fail." in Comparative examples 18, and 21, the conditions for the second thermomechanical treatment and the third thermomechanical treatment were not appropriate.

In Comparative example 15, since the average equivalent circle diameter of austenite after deep cooling was not appropriate, the fracture-resisting performance of the base metal or of the welded joint was "fail." In Comparative example 15, the conditions for the second thermomechanical treatment were not appropriate.

Meanwhile, in Examples 1, 8, 13, and 21, and Comparative examples 1, 8, 13, and 21, the controlled cooling in the second thermomechanical treatment was air cooling. Similarly, in Examples other than Examples 2, 4, 6, 9, 14, 17, 20, 23, and 26, and Comparative Examples other than Comparative examples 2, 4, 6, 9, 14, 17, 20, 23, and 26, the controlled cooling in the third thermomechanical treatment was air cooling.

Thus far, preferable examples of the invention have been described, but the invention is not limited to the examples. Within the scope of the purports of the invention, addition, removal, substitution, and other changes of the configuration are possible. The invention is not limited by the above description, and is limited only by the attached claims.

INDUSTRIAL APPLICABILITY

It is possible to provide an inexpensive steel plate that is excellent in fracture-resisting performance at approximately −160° C. with a Ni content of approximately 9% and a method of manufacturing the same.

The invention claimed is:

1. A Ni-added steel plate comprising, by mass %:
C: 0.04% to 0.10%;
Si: 0.02% to 0.12%;
Mn: 0.3% to 1.0%;
Ni: more than 7.5% to 10.0% or less;
Al: 0.01% to 0.08%;
T.O: 0.0001% to 0.0030%;
P: limited to 0.0100% or less;
S: limited to 0.0035% or less;
N: limited to 0.0070% or less; and
the balance of Fe and unavoidable impurities,
wherein a Ni segregation ratio at an area of ¼ of a plate thickness away from a plate surface in a thickness direction is 1.3 or less, a fraction of austenite, an austenite unevenness index, and an average equivalent circle diameter of the austenite measured in a deep cooled sample of the Ni-added steel plate is 0.5% or more, 3.0 or less, and 1 μm or less, respectively.

2. The Ni-added steel plate according to claim 1, further comprising, by mass %, at least one of:
Cr: 1.5% or less;
Mo: 0.4% or less;
Cu: 1.0% or less;
Nb: 0.05% or less;
Ti: 0.05% or less;
V: 0.05% or less;
B: 0.05% or less;
Ca: 0.0040% or less;
Mg: 0.0040% or less; and
REM: 0.0040% or less.

3. The Ni-added steel plate according to claim 1 or 2, wherein the plate thickness is 4.5 mm to 80 mm.

4. A method of manufacturing a Ni-added steel plate comprising:
performing a first thermomechanical treatment with respect to a steel including, by mass %,
C: 0.04% to 0.10%;
Si: 0.02% to 0.12%;
Mn: 0.3% to 1.0%;
Ni: more than 7.5% to 10.0% or less;
Al: 0.01% to 0.08%;
T.O: 0.0001% to 0.0030%;
P: limited to 0.0100% or less;
S: limited to 0.0035% or less;
N: limited to 0.0070% or less; and
the balance of Fe and unavoidable impurities, wherein the steel is held at a heating temperature of 1250° C. or higher and 1380° C. or lower for 8 hours or longer and 50 hours or shorter and thereafter is cooled by an air cooling to 300° C. or lower;
performing a second thermomechanical treatment with respect to the steel, wherein the steel is heated to 900° C. or higher and 1270° C. or lower, is subjected to a hot rolling at a rolling reduction ratio of 2.0 or more and 40 or less while a temperature at one pass before a final pass is controlled to 660° C. or higher and 900° C. or lower and thereafter is cooled to 300° C. or lower immediately; and
performing a third thermomechanical treatment with respect to the steel, wherein the steel is heated to 500° C. or higher and 650° C. or lower and thereafter is cooled.

5. The method of manufacturing the Ni-added steel plate according to claim 4,
wherein the steel further comprises, by mass %, at least one of
Cr: 1.5% or less;
Mo: 0.4% or less;
Cu: 1.0% or less;
Nb: 0.05% or less;
Ti: 0.05% or less;
V: 0.05% or less;
B: 0.05% or less;
Ca: 0.0040% or less;
Mg: 0.0040% or less; and
REM: 0.0040% or less.

6. The method of manufacturing the Ni-added steel plate according to claim 4 or 5, wherein, in the first thermomechanical treatment, before the air cooling, the steel is subjected to a hot rolling at a rolling reduction ratio of 1.2 or more to 40 or less while a temperature at one pass before a final pass is controlled to 800° C. or higher and 1200° C. or lower.

7. The method of manufacturing the Ni-added steel plate according to claim 4 or 5, wherein, in the second thermomechanical treatment, the steel is cooled to 300° C. or lower immediately after the hot rolling and is reheated to 780° C. or higher and 900° C. or lower.

8. The method of manufacturing the Ni-added steel plate according to claim 4 or 5, wherein, in the first thermomechanical treatment, before the air cooling, the steel is subjected to the hot rolling at the rolling reduction ratio of 1.2 or more and 40 or less while the temperature at one pass before the final pass is controlled to 800° C. or higher and 1200° C. or lower, and in the second thermomechanical treatment, the steel is cooled to 300° C. or lower immediately after the hot rolling and is reheated to 780° C. or higher and 900° C. or lower.

* * * * *